US010800052B1

(12) United States Patent
Fossella

(10) Patent No.: US 10,800,052 B1
(45) Date of Patent: Oct. 13, 2020

(54) UTILITY KNIFE, BLADE, AND CARTRIDGE

(71) Applicant: Repetto LLC, Scituate, MA (US)

(72) Inventor: Gregory Fossella, Hull, MA (US)

(73) Assignee: Repetto LLC, Scituate, MA (US)

( * ) Notice: Subject to any disclaimer, the term of this patent is extended or adjusted under 35 U.S.C. 154(b) by 0 days.

(21) Appl. No.: 16/452,270

(22) Filed: Jun. 25, 2019

Related U.S. Application Data

(60) Provisional application No. 62/861,212, filed on Jun. 13, 2019.

(51) Int. Cl.
*B26B 5/00* (2006.01)
*B25G 1/08* (2006.01)

(52) U.S. Cl.
CPC ..... *B26B 5/003* (2013.01); *B25G 1/08* (2013.01)

(58) Field of Classification Search
CPC ..... B26B 27/005; B26B 5/001; B26B 5/003
USPC ..... 30/2, 162
See application file for complete search history.

(56) References Cited

U.S. PATENT DOCUMENTS

| | | | |
|---|---|---|---|
| 2,390,964 | A | 12/1945 | Savoy |
| 2,596,303 | A | 5/1952 | Stead |
| 2,870,537 | A | 1/1959 | Ortner |
| 2,948,961 | A | 8/1960 | Ortner |
| 2,984,003 | A | 5/1961 | Minton |
| 3,577,637 | A | 5/1971 | Braginetz |
| 3,593,417 | A | 7/1971 | West et al. |
| 3,660,896 | A | 5/1972 | Umholtz |
| 3,708,881 | A | 1/1973 | Bennett |
| 3,872,591 | A | 3/1975 | Quenot |
| 3,906,627 | A | 9/1975 | Manning |
| D242,980 | S | 1/1977 | Fuller et al. |
| 4,005,525 | A | 2/1977 | Gringer |
| 4,277,888 | A | 7/1981 | Szabo |
| 4,517,741 | A | 5/1985 | Castelluzzo |
| 4,612,707 | A | 9/1986 | Shea |

(Continued)

FOREIGN PATENT DOCUMENTS

| | | |
|---|---|---|
| GB | 2 269 128 A | 2/1994 |
| WO | WO 03/009975 A2 | 2/2003 |

OTHER PUBLICATIONS

[No Author Listed] Soft Grip Tools for Hart Hat® Jobs. Allway Tools, Inc. 2005:2-7.

(Continued)

*Primary Examiner* — Kenneth E Peterson
(74) *Attorney, Agent, or Firm* — Wolf, Greenfield & Sacks, P.C.

(57) ABSTRACT

A utility knife has a disposable blade cartridge in its handle that has new and used blade compartments. Fresh blades are disposed in the new blade compartment and one end of each is advanced one at a time substantially out of the compartment into operative position by a carrier that is controlled by a push button assembly. When the active blade is to be replaced, it is moved by the carrier into the used blade compartment, and a new blade may then be withdrawn from the new blade compartment into the operative position. The cartridge may be reversed when the one end of all the blades in the new blade compartment are used, placing what was the used blade compartment at the front, and the unused end of each blade may be advanced into the operative position. When all are used, a new cartridge may replace the used cartridge.

16 Claims, 31 Drawing Sheets

(56) References Cited

U.S. PATENT DOCUMENTS

| | | | | |
|---|---|---|---|---|
| 4,761,882 | A | 8/1988 | Silverstein | |
| 4,813,132 | A | 3/1989 | Castelluzzo | |
| 5,258,001 | A * | 11/1993 | Corman | A61B 17/3211 30/162 |
| 5,386,632 | A | 2/1995 | Schmidt | |
| 5,404,645 | A | 4/1995 | Janser | |
| 5,426,855 | A | 6/1995 | Keklak et al. | |
| 5,435,062 | A | 7/1995 | Huang | |
| 5,604,984 | A | 2/1997 | Shepherd et al. | |
| 5,644,843 | A | 7/1997 | Young | |
| 5,720,105 | A | 2/1998 | Gates | |
| 5,727,320 | A | 3/1998 | Shepherd et al. | |
| 5,890,294 | A | 4/1999 | Keklak et al. | |
| 5,909,930 | A | 6/1999 | Ragland, III et al. | |
| 5,924,203 | A | 7/1999 | Huang | |
| 5,960,544 | A | 10/1999 | Beyers | |
| 5,960,545 | A | 10/1999 | Shepherd et al. | |
| 6,148,522 | A | 11/2000 | Dobandi | |
| 6,233,830 | B1 | 5/2001 | Lamond et al. | |
| 6,263,577 | B1 * | 7/2001 | Wonderley | B26B 5/003 30/152 |
| 6,327,780 | B1 | 12/2001 | Bigham et al. | |
| 6,374,497 | B1 | 4/2002 | Sun | |
| 6,415,514 | B1 | 7/2002 | Chun | |
| D462,250 | S | 9/2002 | Ping | |
| 6,454,427 | B1 | 9/2002 | Chen | |
| 6,487,778 | B1 | 12/2002 | Gringer et al. | |
| 6,513,246 | B2 | 2/2003 | Ping | |
| 6,678,958 | B1 | 1/2004 | Budrow | |
| 6,829,827 | B2 | 12/2004 | Tseng | |
| 6,848,185 | B2 | 2/2005 | Tebo | |
| 6,886,257 | B2 | 5/2005 | Chih | |
| 6,895,674 | B2 | 5/2005 | Ai | |
| 6,925,920 | B1 * | 8/2005 | Borosic | B26D 7/2628 30/339 |
| 6,948,250 | B1 * | 9/2005 | Caiafa, Jr. | B26B 1/08 30/151 |
| 6,951,055 | B1 | 10/2005 | Collins | |
| 6,966,113 | B2 | 11/2005 | Fossella | |
| 7,305,770 | B2 | 12/2007 | Critelli et al. | |
| 7,395,600 | B2 | 7/2008 | Fossella | |
| 7,418,784 | B2 | 9/2008 | Fossella | |
| 7,533,467 | B2 | 5/2009 | Fossella | |
| D606,838 | S | 12/2009 | van Deursen | |
| 8,156,653 | B2 * | 4/2012 | Austria | A61B 17/3213 30/161 |
| 8,621,753 | B2 | 1/2014 | Price | |
| 8,689,450 | B2 | 4/2014 | Constantine et al. | |
| 2002/0029480 | A1 | 3/2002 | Lin | |
| 2004/0000055 | A1 | 1/2004 | Lee Fan | |
| 2004/0040159 | A1 | 3/2004 | Fossella | |
| 2004/0187314 | A1 | 9/2004 | Johnson | |
| 2005/0028380 | A1 | 2/2005 | Fossella | |
| 2006/0059693 | A1 | 3/2006 | Fossella | |
| 2006/0242841 | A1 | 11/2006 | Fossella | |
| 2007/0044322 | A1 * | 3/2007 | Trbovich, Jr. | B26B 3/00 30/294 |
| 2007/0227012 | A1 * | 10/2007 | Constantine | B26B 5/001 30/162 |
| 2007/0240314 | A1 | 10/2007 | Ireland | |
| 2008/0282547 | A1 * | 11/2008 | Leger | B26B 1/08 30/162 |
| 2009/0094840 | A1 * | 4/2009 | Kanemoto | B26B 5/001 30/162 |
| 2012/0073143 | A1 * | 3/2012 | Honda | B26B 5/002 30/162 |
| 2012/0102757 | A1 * | 5/2012 | Kanemoto | B26B 5/001 30/156 |
| 2012/0125541 | A1 * | 5/2012 | Nazarian | B08B 9/083 156/750 |

OTHER PUBLICATIONS

[No Author Listed] Cutting Solutions for All Applications. American Cutting Edge, Inc. Publicly available prior to Jan. 8, 2009. 10 pages.

[No Author Listed] Blade for Cutter and for Art-Knife. Restter Co., Ltd. Publicly available prior to Jan. 8, 2009. 6 pages.

* cited by examiner

UTILITY KNIFE, BLADE, AND CARTRIDGE

RELATED APPLICATIONS

This application claims priority under 35 U.S.C. § 119(e) to U.S. Provisional Application Ser. No. 62/861,212, entitled "UTILITY KNIFE, BLADE, AND CARTRIDGE", filed on Jun. 13, 2019, the disclosure of which is incorporated by reference in its entirety.

FIELD

Disclosed embodiments are related to a utility knife, blade, cartridge, and related methods of use.

BACKGROUND

Utility knives are widely used for a number of different purposes and are a popular tool. Conventionally, utility knives use a thin double-ended blade that in use extends out one end of the knife housing. When the cutting end becomes dull or otherwise unsuited for continued use, the blade is reversed so that its other end extends out of the housing. In most utility knives, reversal of the blade requires handling of the blade, and because the blades are very sharp, thin, and not particularly easy to grasp, blades are frequently dropped or mishandled. Mounting the blade within the utility knife is also oftentimes difficult.

Despite the ubiquity of utility knives in trades such as carpentry, wallboard installation, roofing, and flooring, the typical utility knife suffers from several drawbacks. First, many knives require the user to handle a sharp blade with their bare hands during blade changing. Second, even in commercially available "auto load" utility knives, the user must still discharge the old blade or manipulate the old blade manually to flip to a fresh side. Third, after both sides of each blade have been used, the consumer is left with a sharp blade in his hand as he looks for a safe place to dispose it. Fourth, it is difficult to assess how many blades remain in a utility knife without opening the storage compartment. Fifth, blade changing on roofs or scaffolds presents an additional hazard attempting to dispose the used blade in your hand. While annoying for a consumer, a tradesperson can lose significant time if fresh blades are exhausted in the middle of a job.

SUMMARY

In some embodiments, a utility knife includes a housing configured to receive a multi-blade cartridge, said cartridge having separate first and second blade compartments each configured to hold blades, where each blade has a front portion and a rear portion, and each blade has a front edge extending between upper and lower edges of the blade, and a longitudinal slot extending rearwardly from the front edge, and where the front portion of the blade is a portion of the blade extending rearwardly from a front edge of the blade to a rearmost end of the longitudinal slot. The utility knife also includes a carrier movable relative to the housing along a path for moving a blade from the first blade compartment to an extended position where the front portion of the blade extends out of the housing and from the extended position to the second blade compartment, where the carrier includes an extension which engages at least part of the front portion of the blade to inhibit deflection of the front portion of the blade out of alignment with the path of the carrier.

In some embodiments, a utility knife includes a housing configured to receive a multi-blade cartridge, said cartridge having separate first and second blade compartments each configured to hold blades, and a carrier movable relative to the housing for moving a blade from the first blade compartment to an extended position where the blade extends out of the housing and from the extended position to the second blade compartment. The carrier includes a blade contact surface, a leading edge, and a beveled leading surface which is arranged at an angle between the blade contact surface and the leading edge so that the leading surface guides a rear portion of the blade onto the blade contact surface when the leading surface contacts the rear portion of the blade.

In some embodiments, a utility knife includes a housing configured to receive a multi-blade cartridge, said cartridge having separate first and second blade compartments each configured to hold blades, where each blade has an upper portion including a longitudinal slot extending forwardly from a rear edge of the blade. The utility knife also includes a carrier movable relative to the housing for moving a blade from the first blade compartment to an extended position where the blade extends out of the housing and from the extended position to the second blade compartment. The carrier includes a lifter configured to engage the longitudinal slot when the carrier is moved to move a blade from the first blade compartment to the extended position, and the lifter includes a ramped leading surface configured to engage the longitudinal slot to lift the blade and align the slot with the lifter.

In some embodiments, a blade cartridge for a utility knife includes a cartridge housing including a first blade compartment positioned adjacent a first end of the cartridge housing and a second blade compartment positioned adjacent a second end of the cartridge housing, a plurality of blades disposed in at least one of the first blade compartment and the second blade compartment, and a retaining channel formed in the cartridge housing and configured to receive an alignment post of the utility knife. The retaining channel is sized and shaped so that when the retaining channel receives the alignment post the cartridge is aligned with a cartridge receptacle of the utility knife.

In some embodiments, a blade cartridge for a utility knife includes a cartridge housing including a first blade compartment positioned adjacent a first end of the cartridge housing and a second blade compartment positioned adjacent a second end of the cartridge housing, where the cartridge housing is sized and shaped to be positioned in a cartridge receptacle of the utility knife in at least a first orientation and a second orientation. The blade cartridge also includes a plurality of blades disposed in at least one of the first blade compartment and the second blade compartment, and an indicator formed on the cartridge housing and configured to align with a knife indicator window of the utility knife, where the indicator indicates the orientation of the cartridge within in a cartridge receptacle of the utility knife.

In some embodiments, a blade for a utility knife includes a front portion including a front edge, a rear portion including a rear edge, a least one sharpened lower edge disposed adjacent the front portion or rear portion, and a first longitudinal slot formed in the rear edge. The first longitudinal slot has a first upper surface and a first lower surface, and the first upper surface includes a first lead-in to the first longitudinal slot at the rear edge.

In some embodiments, a blade for a utility knife includes a front portion including a front edge, a rear portion including a rear edge, a least one sharpened lower edge disposed adjacent the front portion or rear portion, and a first longitudinal slot formed in the rear edge, where the first longitudinal slot is non-symmetrical about a central longitudinal axis of the first longitudinal slot; and where the first non-symmetrical longitudinal slot is sized and shaped to receive a lifter of the utility knife which has a size and shape corresponding to that of the first non-symmetrical slot. The blade also includes a second longitudinal slot formed in the front edge, where the second longitudinal slot has an equivalent size and shape to that of the first longitudinal slot.

In some embodiments, a blade cartridge for a utility knife includes a cartridge housing including a first blade compartment positioned adjacent a first end of the cartridge housing and a second blade compartment positioned adjacent a second end of the cartridge housing, where the cartridge housing is sized and shaped to be positioned in a cartridge receptacle of the utility knife in at least a first orientation and a second orientation. The blade cartridge also includes a plurality of blades disposed in at least one of the first blade compartment and the second blade compartment, and a blade window formed on the first end of the cartridge housing and configured to allow a user to view the number of blades in the first blade compartment.

In some embodiments, a utility knife includes a knife housing including a cartridge receptacle and a cartridge disposed in the cartridge receptacle. The cartridge includes a cartridge housing including a first blade compartment positioned adjacent a first end of the cartridge housing and a second blade compartment positioned adjacent a second end of the cartridge housing, where the cartridge housing is sized and shaped to be positioned in a cartridge receptacle of the utility knife in at least a first orientation and a second orientation. The cartridge also includes a plurality of blades disposed in at least one of the first blade compartment and the second blade compartment, and a blade window formed on the first end of the cartridge housing and configured to allow a user to view the number of blades in the first blade compartment. The utility knife also includes a knife window formed on the knife housing which is aligned with the blade window so that a user may view a number of blades in the first blade compartment.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
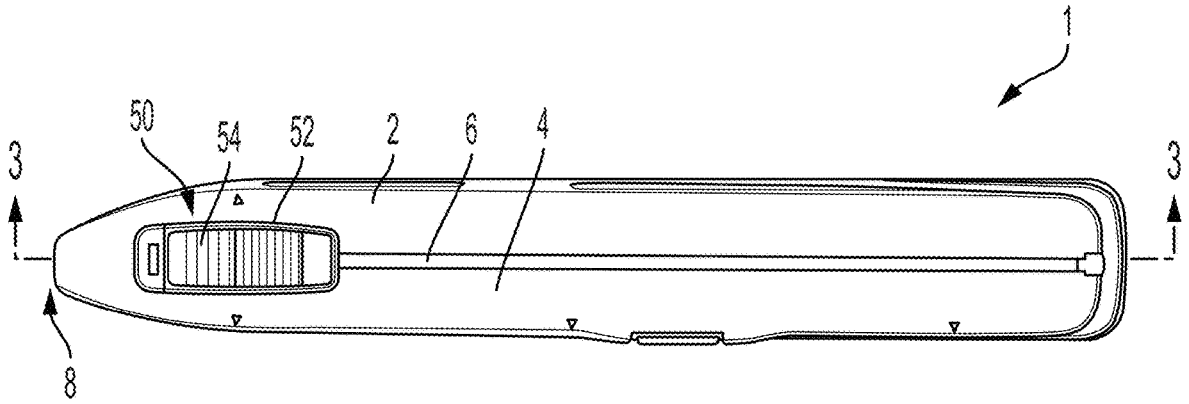
FIG. 1 is a top view of one embodiment of a utility knife.

In some cases, conventional utility knifes have shortcomings which make their operation cumbersome, inconvenient, or otherwise slow down the regular use of the knife. One such shortcoming is conventional push button assemblies may not positively lock a retractable blade in a desired position. That is, the push button assemblies may be overcome with sufficient force applied to a projecting knife blade, such that a knife blade in use may suddenly retract into the knife. Another such shortcoming is that a blade may shift out of a retraction or extension travel path, and induce friction in the knife during operation. In some cases, the blade may jam the knife and inhibit further operation without manually removing the blade from the travel path. Yet another such shortcoming is in many multi-blade knifes a user has no idea how many blades have been used or which side of the blades has been used, such that a user must check every time to determine a number of fresh cutting edges remaining. This counting typically requires removal of the blades and can be a time consuming process.

In view of the shortcomings of conventional utility knives, the inventor has recognized the benefits of a utility knife which addresses each of the deficiencies listed above. In some embodiments, the utility knife includes a push button assembly which engages one or more locking receptacles formed by square locking teeth. The square walls of the locking teeth ensure no amount of force applied to an extended blade may move the push button assembly to allow the blade to unexpectedly retract. In some embodiments, the utility knife includes a blade carrier having a beveled extension which ensures a blade is moved into proper engagement with a blade contact surface and is kept in a planar blade travel path. Such an arrangement inhibits a blade from inadvertently disengaging the carrier and jamming in the knife. In some embodiments, a multi-blade utility knife may include a blade window which allows a user to see the number of blades inside of the knife or inside of a blade cartridge. Such an arrangement allows a user to determine the number of unused cutting edges remaining for the blades disposed in the knife at a glance.

The inventor has also recognized the benefits of a utility knife which allows multiple blades to be rapidly changed without a user ever directly handling a blade. According to exemplary embodiments herein, a utility knife includes a case or housing, a blade cartridge containing a number of blades, a carrier movable within the housing and through the cartridge, and an actuator connected to the carrier and accessibly mounted on the housing. As is described in detail below, the cartridge may contain a pair of compartments and is initially filled with all of the new blades in the same compartment, while the other compartment is empty. The blades are withdrawn from the new blade compartment one at a time so that one end of each blade may be sequentially used, and after each blade requires replacement, it is deposited in the other compartment. When all of the blades have been transferred to the other compartment, the cartridge is reversed in the housing and the unused edges of the blades are sequentially used and then deposited in what becomes the used blade compartment when the cartridge is reversed. In this manner, one edge of each blade is used as the active cutting implement in the utility knife, and when all the blades have one used edge, the cartridge is reversed so as to place the unused edges in position to be used in sequence. Such an arrangement allows a user to use a plurality of blades quickly and easily without ever touching a blade.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 is a top view of one embodiment of a utility knife 1 which addresses the shortcomings of conventional utility knifes. As shown in FIG. 1, the knife includes a right side housing 2, a left side housing 4, and a travel slot 6 formed therebetween. Disposed in the travel slot is a push button assembly 50 which functions as an actuator or user interface for control of the knife 1. The push button assembly 50 includes a push button housing 52 and a push button 54 which is slidably retained in the push button housing. As will be discussed further below, the push button 54 may be activated to selectively retract or extend a blade in use, or to change a blade. When a blade is in use and extended, it projects out of a front housing portion 8. The front housing portion 8 has a knife opening (see FIG. 28A) through which individual blades may be extended to an operative position and through which the blade may be withdrawn into the housing when not in use.

According to the embodiment of FIG. 1, the housing may be a metal casting such as die casting of aluminum or zinc, or may be molded plastic, and the two halves or shells 2, 4 may be secured together by any one or more of a variety of different fasteners such as screws, hook-like fingers, snaps, adhesive, etc. to form an elongated housing for the utility knife components as well as a handle for operating the knife. It should be understood that while the housing in the illustrated embodiment is composed of two half shells split longitudinally along the approximate center line of the housing, the housing may be made up of a different number of parts and the various components may be assembled in a variety of different ways, as the present disclosure is not so limited.

Figure 2:
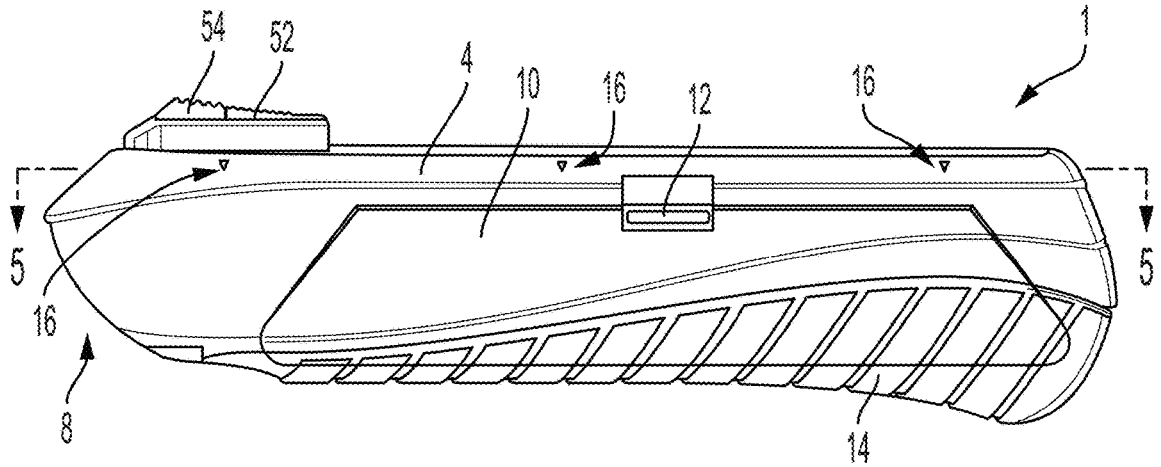
FIG. 2 is a side view of the utility knife of FIG. 1.

FIG. 2 is a side view of the utility knife 1 of FIG. 1. As shown in FIG. 2, the left side housing 4 includes a cartridge door 10 which covers a cartridge receptacle configured to receive a blade cartridge. The cartridge door 10 is secured in the closed position shown in FIG. 2 with a cartridge door latch 12 which may be selectively operated by user to open the cartridge door and get access to the cartridge receptacle. The cartridge door latch may be a spring clip which engages a hole or other receptacle formed in the left side housing. Of course, any suitable latch may be employed for a cartridge door on either side of the utility knife, and/or the cartridge door 10 may be secured by a fastener, interference fit, etc. as the present disclosure is not so limited. As shown in FIG. 2, the knife also includes a textured and curved ergonomic grip 14 which improves the handling of the knife in use. The knife also includes carrier position indicators 16 which indicate the functional position of a carrier disposed in the knife. For example, the leftmost position indicator may indicate a position where an engaged blade may be extended, the middle indicator may indicate a position where an engaged blade is retracted, and the rear indicator may indicate a position where a used blade has been deposited in a used blade compartment. The function of the carrier and cartridge will be discussed in further detail below.

Figure 3:
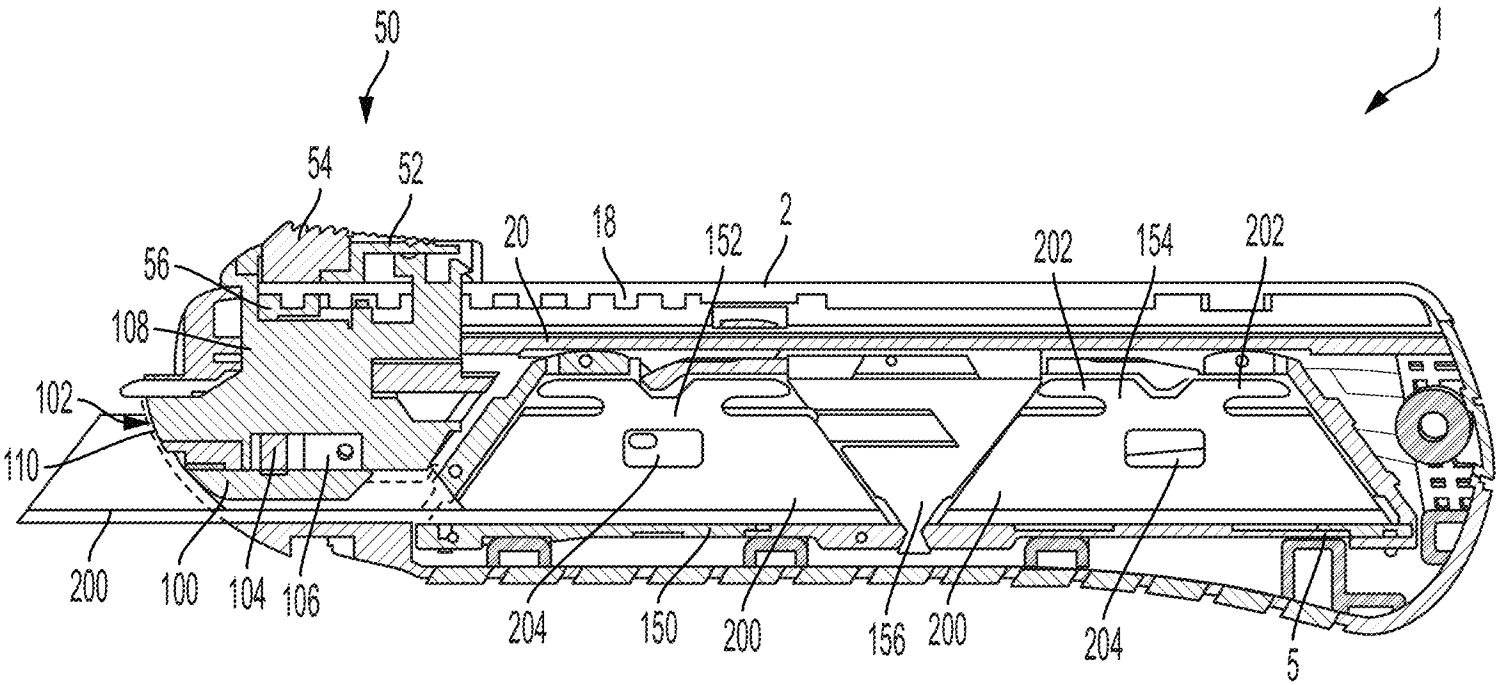
FIG. 3 is a side cross-sectional view of the utility knife of FIG. 1 taken along line 3-3 of FIG. 1.

FIG. 3 is a side cross-sectional view of the utility knife 1 of FIG. 1 taken along line 3-3 showing the internal components enabling rapid and easy blade change. As shown in FIG. 3, the push button assembly 50 is disposed on the knife housing and is configured to control a carrier 100. The carrier is configured to selectively engage blades 200 which are disposed in a blade cartridge 150. The cartridge in turn is disposed in a cartridge receptacle 5 formed in the knife housing. The blade cartridge includes a new blade compartment 152 and a used blade compartment 154. During operation of the knife, blades are moved from the new blade compartment 152 by the carrier to an extended position where the blade extends out of the knife housing. Once the blade is used, the carrier may be retracted with the push button so that the blade is moved to the used blade compartment where it is deposited. Once the used blade is deposited, the carrier may then be moved to pick up a new blade from the new blade compartment. The cycle may be repeated as many times as necessary until the blades are depleted from the new blade compartment and all of the blades are disposed in the used blade compartment.

According to the embodiment of FIG. 3, the push button assembly includes a locking arm 56 which has a locking bar (see FIG. 4A) configured to engage one of the plurality of locking bar receptacles formed by locking teeth 18 which are formed inside of the knife housing. As will be discussed further with reference to FIGS. 4A-4B, the locking bar engages the teeth when the push button 54 is not depressed, and is moved out of engagement when the push button is depressed so that the carrier 100 may be moved along the travel slot.

The carrier 100 includes a blade contact surface 102 which receives a surface of the engaged blade 200 and maintains the blade in a planar travel path. A lifter (see FIG. 11) formed on the blade contact surface contacts blade sliders 202 to lift and align the blade with the blade contact surface. The carrier also includes a support 104 which is biased towards the engaged blade with a support spring 106. The support engages a support hole 204 formed in each of the blades and helps maintain the engaged blade's vertical position. The support also is formed so that the carrier may be used to apply a retraction force to an extended blade, as will be discussed further with reference to FIG. 15. The carrier includes a carrier guide 108 which is operatively coupled to a carrier rail 20 formed in the knife housing. The carrier slides along the carrier rail between various positions under control of the push button assembly. According to the embodiment of FIG. 3, the carrier also includes a carrier extension 110 which supports a front portion of the engaged blade and inhibits the engaged blade from moving out of a planar travel path, where a front portion of the blade may be a portion of the blade extending rearwardly from a front edge of the blade to a rearmost end of a longitudinal slot extending rearwardly from the front edge (for example, see FIGS. 13-14).

As shown in FIG. 3, the blade cartridge 150 includes a cartridge insert 156 which separates the new blade compartment 152 from the used blade compartment 154. The insert is configured to allow one-way travel of the blades 200 in a direction from the new blade compartment to the used blade compartment. Thus, when the carrier 100 is moved to the rear of the knife, a used blade may be reliably deposited in the used blade compartment without the risk of the used blade being moved back to the new blade compartment.

Figure 4A:
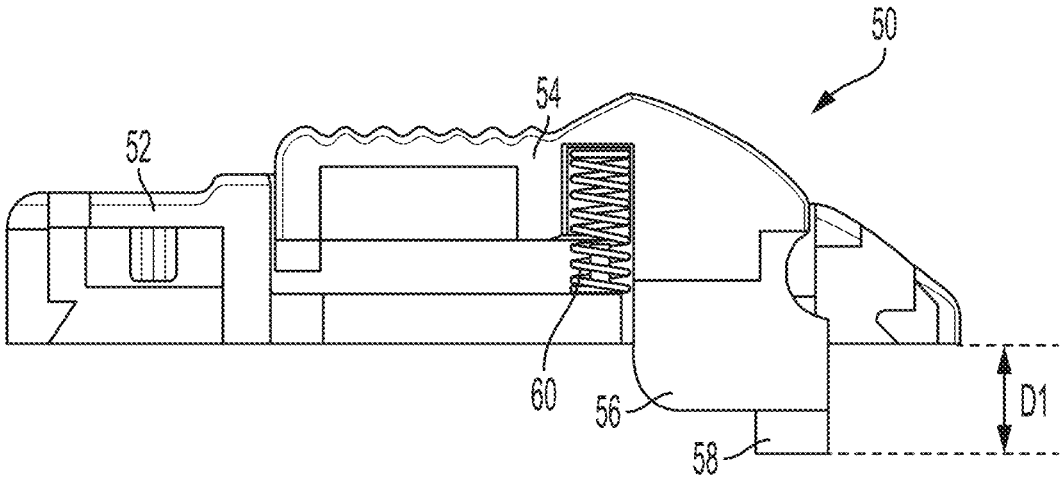
FIG. 4A is a cross-sectional view of one embodiment of a push button assembly in a first position.

FIG. 4A is a cross-sectional view of one embodiment of a push button assembly 50 in a first position. As shown in FIG. 4A, the push button assembly includes a push button housing 52 and a push button 54 slidably disposed in the push button housing. The push button includes a locking arm 56 on which a locking bar 58 is disposed. The locking bar is configured to selectively engage locking teeth to inhibit the movement of the push button assembly along a travel slot of a knife. The push button assembly also includes a push button spring 60 disposed between the push button and push button housing which biases the push button towards a raised position where the locking bar 58 is closer to the push button housing. Accordingly, in a knife where locking teeth are disposed between the locking bar 58 and the push button housing 52, the position shown in FIG. 4A corresponds to a locked position where the push button assembly may not be moved along a travel slot of a knife. As shown in FIG. 4A, the locking bar 58 is separated from the push button housing 52 by a first distance D1.

Figure 4B:
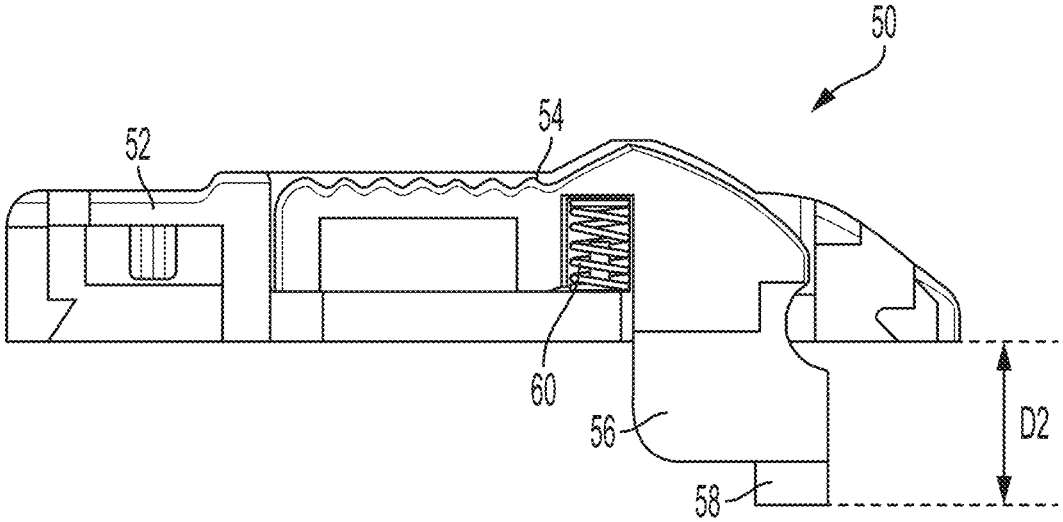
FIG. 4B is a cross-sectional view of the push button assembly of FIG. 4A in a second position.

FIG. 4B is a cross-sectional view of the push button assembly 50 of FIG. 4A in a second position. Compared with the position shown in FIG. 4A, the push button 54 has been depressed and moved downwards relative to the push button housing 52. Accordingly, the push button spring 60 has been compressed, and the locking bar has been moved further away from the push button housing. That is, the locking bar is now separated from the push button housing by a distance D2 which is greater than D1. D2 and D1 may be selected for suitable height locking teeth, so long as the locking bar clears the locking teeth when the push button 54 is depressed.

Of course, while a push button and push button housing are employed in the embodiment of FIG. 1, any suitable activator for the knife may be employed, including, but not limited to, a twist knob configured to convert rotary motion to linear motion of the carrier, and a lever that may be lifted/tilted to move the carrier.

Figure 5:
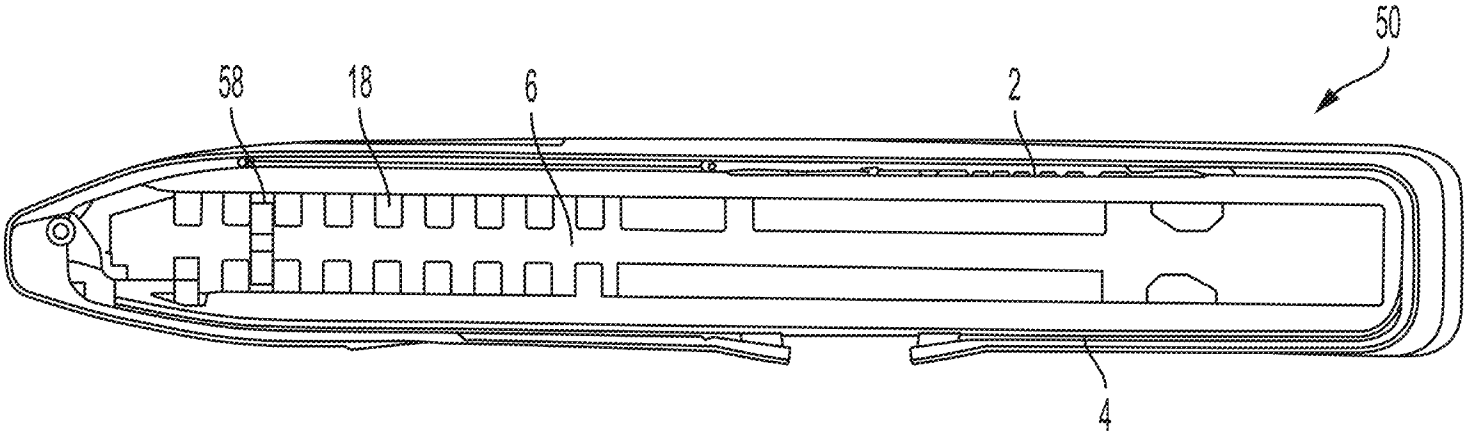
FIG. 5 is a top cross-sectional view of the utility knife of FIG. 1 taken along line 5-5 of FIG. 2.

FIG. 5 is a top cross-sectional view of the utility knife 1 of FIG. 1 taken along line 5-5 of FIG. 2 showing a locking bar 58 and a plurality of locking teeth 18. As shown in FIG. 5, the locking teeth have a square or rectangular profile, so that one or more surfaces of the teeth are perpendicular to the travel slot 6 which extends in a longitudinal direction of the knife. Likewise, the locking bar 58 of the push button assembly includes surfaces which engage the locking teeth surfaces that are perpendicular to the travel slot 6. Accordingly, when the locking bar and locking teeth engage one another, force applied to the knife and/or push button assembly in a direction of the travel slot is not able to move the locking bar out of engagement with the locking teeth so that the blade is securely maintained in a locked position.

Figure 6:
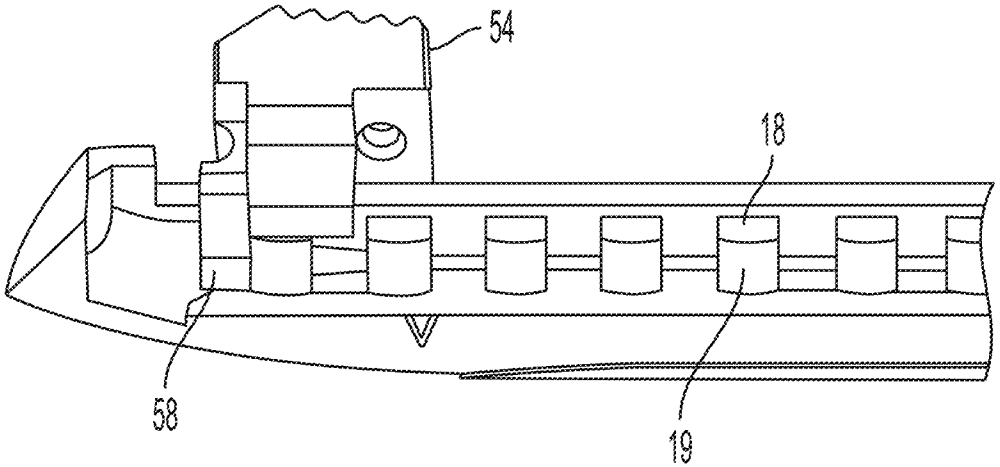
FIG. 6 is an enlarged perspective view of one embodiment of a locking teeth and push button assembly.

FIG. 6 is an enlarged perspective view of one embodiment of locking teeth 18 and push button assembly 50. As shown in FIG. 6, each of the locking teeth include rounded ends 19 which guide the locking bar 58 into engagement two locking teeth. Such an arrangement is beneficial to automatically align locking bar with a locking position if a user releases push button 54 without the locking bar 58 being aligned with a locking receptacle between two of the locking teeth.

Figure 7:
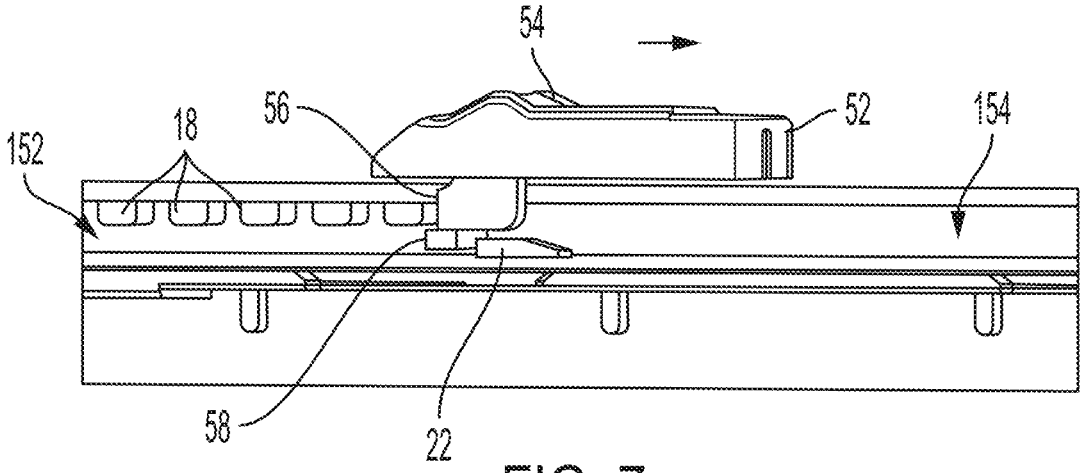
FIG. 7 is a perspective view of the locking teeth and push button assembly of FIG. 6 in a first position.
Figure 8:
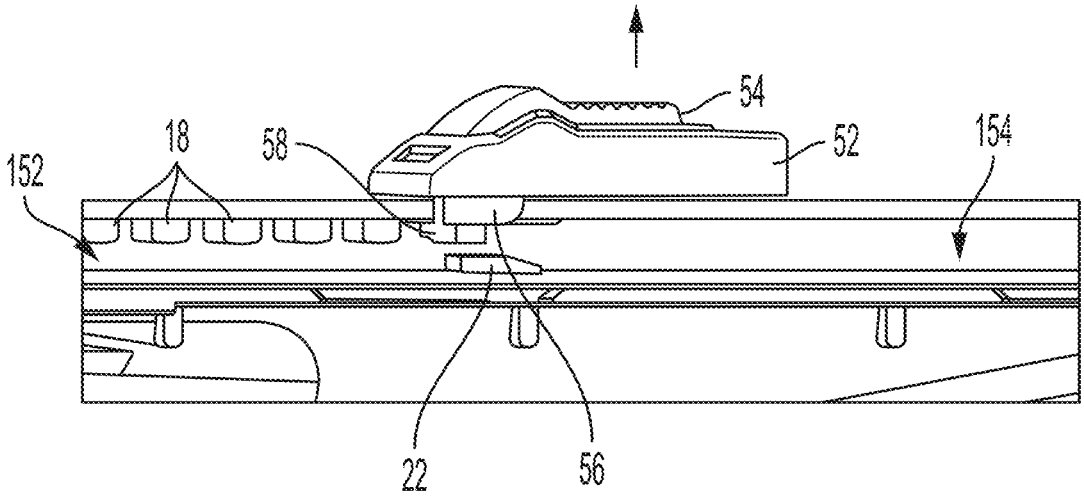
FIG. 8 is a perspective view of the locking teeth and push button assembly of FIG. 6 in a second position.
Figure 9:
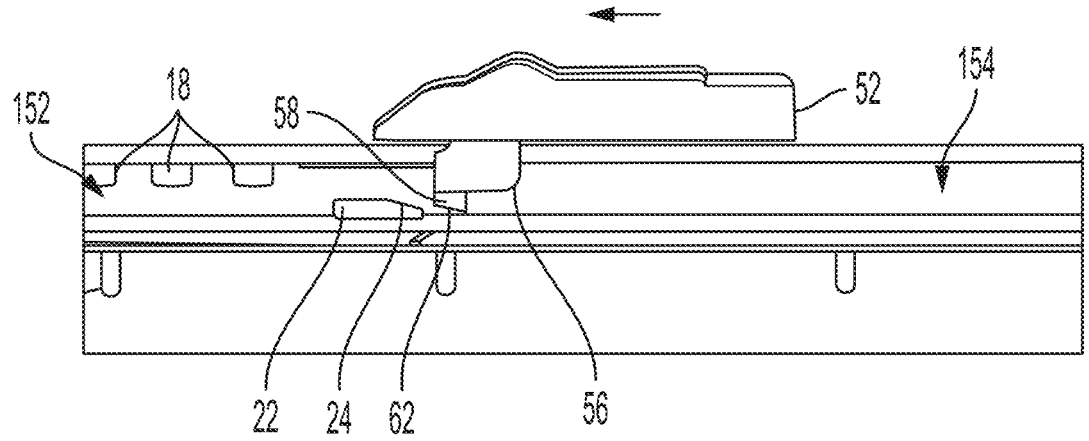
FIG. 9 is a side view of the locking teeth and push button assembly of FIG. 6 in a third position.

FIGS. 7-9 depict view of the locking teeth 18 and push button assembly of FIG. 6 in various positions as the push button is moved along a travel slot. As shown in FIG. 7, the push button 54 is depressed and the locking bar 58 correspondingly clears locking teeth 18, allowing the push button assembly to be moved rearward in the direction shown by the arrow without interfere from the locking teeth. As noted above, a knife may include a cartridge having a new blade compartment 152 and a used blade compartment 154, and moving a blade from the new blade compartment to the used blade compartment may be irreversible through operation of the push button assembly (for example, see FIGS. 56-58). Accordingly, it may be desirable to inhibit a user from inadvertently moving a blade to the used blade compartment when retracting a blade for temporary storage. As shown in FIG. 7, the knife may include an entry stop 22 which is configured to inhibit movement of the push button assembly to the used blade compartment when the push button is depressed. That is, the locking bar 58 engages the entry stop 22 and inhibits further movement of the push button assembly in the direction shown by the arrow in FIG. 7. Accordingly, a user unlocking the locking bar from the locking teeth and retracting the blade may not inadvertently move a blade to the used blade compartment. Instead, as shown in FIG. 8, a user may release the push button 54 to allow the locking bar 58 to clear the entry stop 22. When the locking bar 58 has cleared the entry stop, the push button assembly may then be moved to the used blade compartment to deposit a used blade there. Once a used blade is deposited, the push button assembly may be moved back towards the new blade compartment to pick up a new blade, as shown in FIG. 9. According to the embodiment of FIGS. 7-9, the entry stop 22 includes an entry stop ramp 24 and locking bar 58 includes a complementary locking bar ramp 62. As the push button assembly is moved toward the new blade compartment (i.e., in the direction shown by the arrow in FIG. 9), the entry stop ramp may contact the locking bar ramp 62 to lift the locking bar so that the entry stop does not inhibit movement of the push button assembly toward the new blade compartment. Accordingly, even if the push button 54 is depressed, the entry stop will not impede movement of the push button assembly to the new blade compartment.

Figure 10:
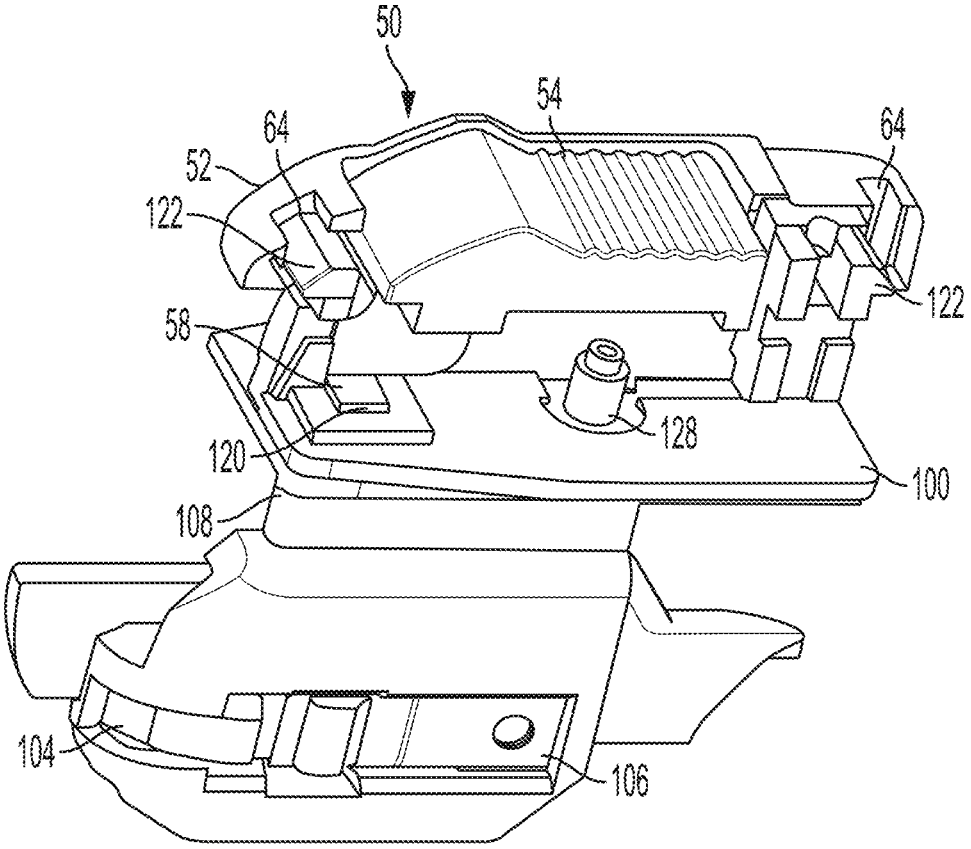
FIG. 10 is a perspective view of one embodiment of a carrier and push button assembly.

FIG. 10 is a perspective view of one embodiment of a carrier 100 and push button assembly 50. The push button assembly 50 is connected to the carrier with flanged carrier latches 122 which engage latch receptacles 64 formed in the push button housing 52. Accordingly, the push button assembly may be used to move the carrier along a travel slot in a knife. As shown in FIG. 10, the carrier also includes a locking bar receptacle 120 which receives the locking bar when the push button 54 is depressed. The locking bar receptacle is sized and shaped so that the reception of the locking bar 58 allows for increased force transmission and stability between the push button assembly and the carrier as the carrier is moved along the travel slot. As shown in FIG. 10, the carrier also includes cam post 128 configured to receive a cam which controls a direction of the movement of the carrier in certain positions along the travel slot, as will be discussed further with reference to FIGS. 56-58.

Figure 11:
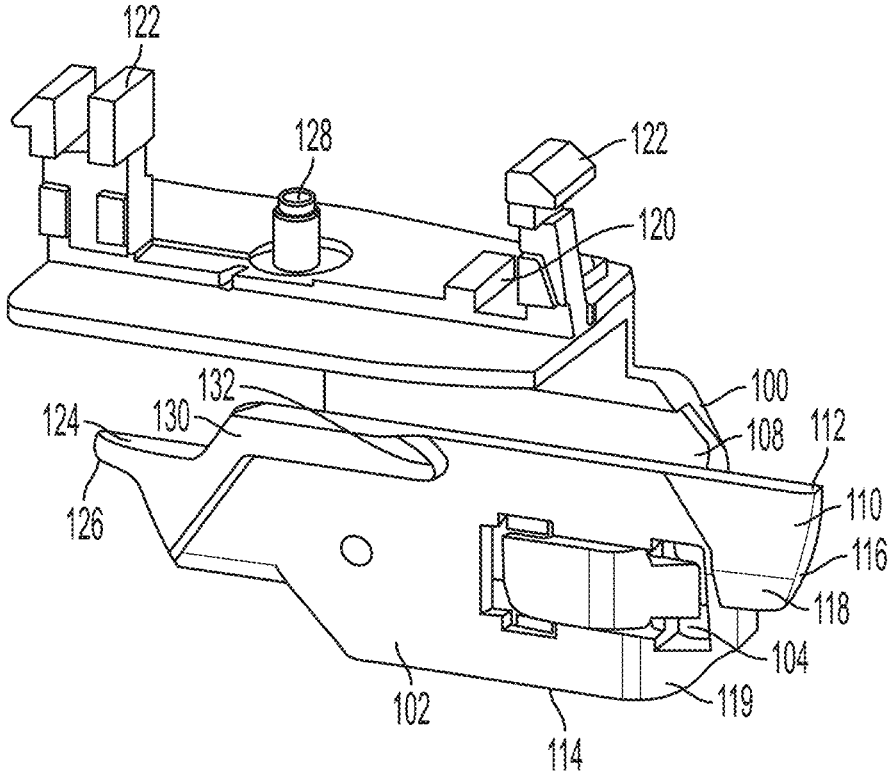
FIG. 11 is a perspective view of the carrier of FIG. 10.
Figure 12:
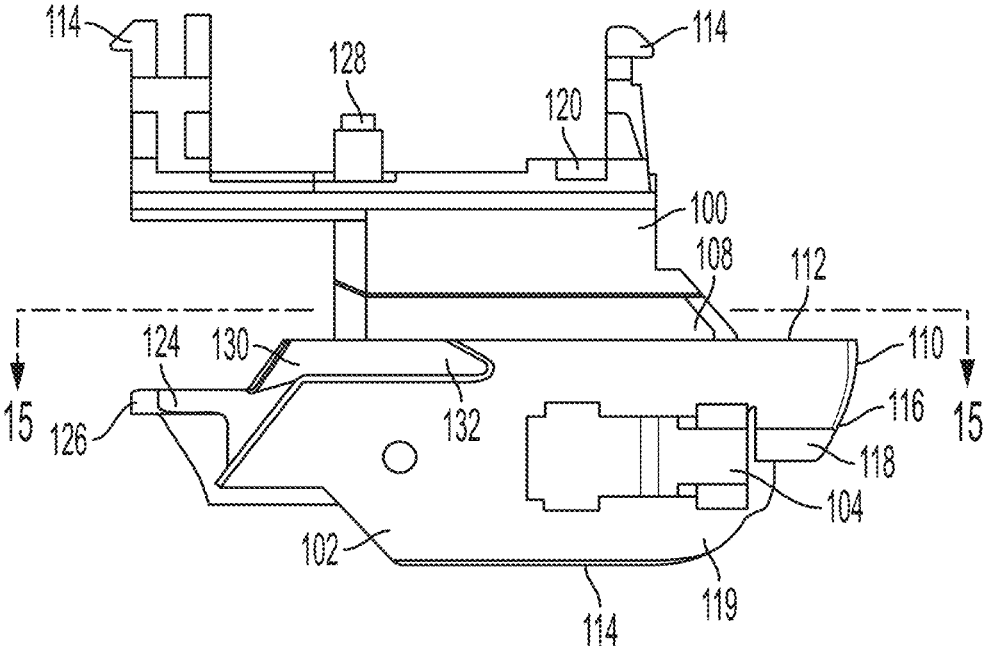
FIG. 12 is a side view of the carrier of FIG. 10.

FIG. 11 is a perspective view and FIG. 12 is a side view of the carrier 100 of FIG. 10 showing a blade contact surface 102 and related blade engagement features. As discussed above, the carrier includes a support 104 which is configured to engage a hole formed in a blade. The support 104 is sprung and is biased to project out from the blade contact surface 102. A blade is configured to rest on and remain parallel with the blade contact surface 102 when engaged. Opposite the blade contact surface may be a wall of a knife so that a planar travel path approximately the width of the blade is formed so that the blade is maintained in the travel path. As shown in FIGS. 11-12, the carrier includes an extension 110 which extends the dimension of the blade contact surface from a front edge of the blade contact surface along an upper edge 112 of the contact surface. The extension forms approximately 5-10% of the blade contact surface area and is configured to support a front portion of a blade to inhibit deflection of the front portion of the blade out of the travel path. In particular, the carrier extension in combination with the blade contact surface is configured to support approximately 75% of an uppermost portion of the blade as defined by an upper longitudinal dimension to inhibit bending or deflection of the blade as it is moved by the carrier. In some embodiments, the carrier extension only contacts an upper half of the blade.

As shown in FIGS. 11-12, the carrier extension includes a curved leading edge 116 which has a beveled leading surface 118 configured to move a blade onto the blade contact surface 102 when the carrier 100 comes into contact with a rear edge of the blade. The beveled leading surface is inclined relative to the blade contract surface, so that the beveled leading surface forms a lead-in to the blade contact surface. The beveled leading surface extends from a lower boundary along a bottom of the carrier extension along the leading edge 116 of the extension to an upper boundary at the upper edge 112 so that a blade contacting either a bottom of the extension or the leading edge of the extension is guided by the beveled leading surface onto the blade contact surface. That is, the beveled leading surface is formed as at least two faces, so that the blade contact surface is disposed in a first plane, a first face is disposed in a second, different plane, and a second face is disposed in a third plane different from the first and second planes (see FIGS. 12A-12C).

According to the embodiment of FIGS. 11-12, the leading edge 116 is curved and tapers from a front-most portion of an upper edge 112 downward and rearward toward a bottom edge 114 of the blade contact surface, which further encourages a contacted blade to move onto the blade contact surface. Accordingly, an intersection between the leading edge 116 and upper edge 112 forms a leading end of the carrier extension 110. Similarly to the beveled surface 118, the blade contact surface 102 includes a second beveled surface 119 formed along lower leading edge of the blade contact surface adjacent the bottom edge 114 of the blade contact surface. The second beveled surface is also inclined relative to the blade contact surface and is configured to guide a contacted blade onto the blade contact surface.

According to the embodiment of FIGS. 11-12, the carrier also includes a lifter 130 which projects out of the blade contact surface. Unlike the support 104, the lifter is integrally formed with the blade contact surface and remains stationary relative to the blade contact surface. The lifter includes a leading edge 132 which is ramped and configured to engage a blade slider and slot. As the leading edge engages a blade, the ramp may lift and orient the blade so that the blade can be secured to the blade contact surface and the support 104 can engage a support hole formed in the blade. The lifter is sized and shaped to fit in a slot formed in the blade, so that the orientation of the blade is maintained as it is disposed on the blade contact surface.

The carrier of FIGS. 11-12 also includes a gate opener 124 which is configured to operate a gate formed on a cartridge insert to allow a blade disposed on the blade contact surface to be moved into a used blade compartment of the cartridge. The gate opener includes a gate opener point 126 which is formed as a ramp that moves a gate on the cartridge insert out of a blocking position so that the blade may be moved to the used blade compartment. In some embodiments the gate opener point may also move blades already disposed in the used blade compartment, springs, or other structures which may block the engaged blade from moving to the used blade compartment out of the way.

Figure 12A:
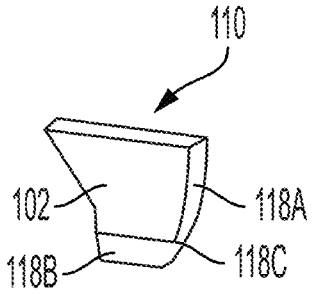
FIG. 12A is a perspective view of one embodiment of a carrier extension.
Figure 12B:
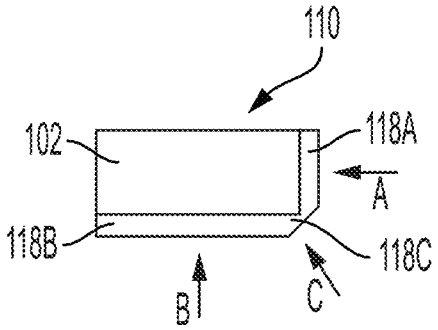
FIG. 12B is a side view of the carrier extension of FIG. 12A.
Figure 12C:
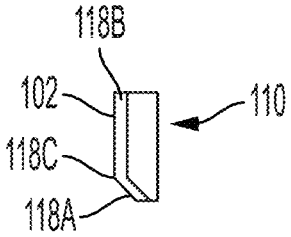
FIG. 12C is a bottom view of the carrier extension of FIG. 12A.

FIGS. 12A-12C depict various views of one embodiment of a carrier extension 110 which guides a blade onto a contact surface 102. FIG. 12A is a perspective view of the carrier extension 110 showing the arrangement of the beveled leading surface 118A, 118B, 118C relative to a blade contact surface 102. As discussed above, the blade contact surface 102 is configured to engage a blade when the blade is carried by a carrier. As the carrier is moved to pick up a new blade (i.e., from a new blade compartment), the carrier extension 110 contacts the blade first to guide the blade onto the blade contact surface and inhibit any jams or misalignment of the blade. As shown in FIG. 12A, the beveled leading surface is configured in a first face 118A, a second face 118B, and a transition region 118C. Each of the first face 118A, second face 118B, and transition region 118C are inclined at a non-zero angle away from a plane defined by the blade contact surface 102. However, the first face, second face, and transition region are each angled away from the blade contact surface in a different direction, so as to create lead-ins to the blade contact surface from multiple directions of blade contact. Accordingly, a blade moved in a first direction toward the first face or a second different direction toward the second face is guided onto the blade contact surface because the first face and second face are angled in different directions. Put another way, the first face is disposed in a first plane which is inclined to and intersects the blade contact surface, whereas the second face is disposed in a second plane which is also inclined to and intersects with the blade contact surface but is a different non-parallel plane to the first plane. The transition region 118C may be a curved surface transitioning between the first plane and the second plane, or, in some embodiments, may be a third plane which intersects both the first plane and second plane. Put still yet another way, the first face 118A and second face 118B may form two sides of a truncated pyramid with the blade contact surface 102 being a top of the truncated pyramid, such that the first face and second face both form ramps up to the blade contact surface.

FIGS. 12B and 12C are a side view and bottom view, respectively of the carrier extension shown in FIG. 12A. As noted above, the first face 118A and second face 118B of the beveled leading surface form distinct ramps which guide a contacted blade onto the blade contact surface 102. The transition region 118C is likewise inclined relative to the blade contact surface and connects the first face and second face so that they form a continuous surface. Accordingly, as shown in FIG. 12B, when a blade is moved into contact with the first face 118A in a first direction A (e.g., a horizontal direction), the first face guides the blade onto the blade contact surface. When a blade is moved into contact with the first face in a second direction B (e.g., a vertical direction), the second face 118B guides the blade onto the blade contact surface. When a blade is moved into contact with the transition region 118C in a third direction C (e.g., a combination of vertical and horizontal), the transition region guides the blade onto the contact surface. The angles of the various surfaces are also shown in FIG. 12C, which shows the first face 118A and second face 118B inclined relative to the blade contact surface with the transition regions 118C connecting them into a continuous surface. According to the embodiment of FIGS. 12A-12C, the first face 118A, second face 118B, and transition region 118C may each be angled relative to the blade contact surface by an angle of approximately 15° which may provide a suitable lead-in for guiding a blade onto the blade contact surface. Of course, other angles of inclination of the first face, second face, and transition region may be employed, including, but not limited to, angles less than or approximately equal to 15°, 25°, 35°, 45°, and 55° as the present disclosure is not so limited. It should also be noted that while a carrier extension having two faces and a transition region is shown in FIGS. 12A-12C, any suitable number of inclined faces may be employed to form a beveled leading surface for guiding a blade onto a blade contact surface, as the present disclosure is not so limited.

Figure 13:
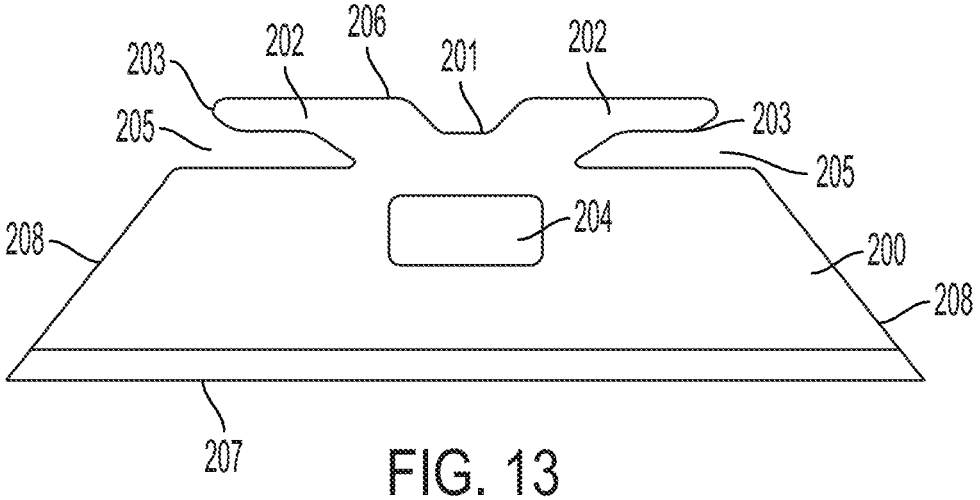
FIG. 13 is a side view of one embodiment of a blade.

FIG. 13 is a side view of one embodiment of a blade 200 for use with utility knives of exemplary embodiments described herein. The blade includes two side edges 208 (e.g., front and rear edges), an upper edge 206, and a lower edge 207. Two blade sliders 202 are disposed adjacent the upper edge. Each of the sliders defines a longitudinal slot 205 formed in the side edges, which each extend horizontally from a side edge toward a vertical centerline of the blade. The slots include slot leading edges 203 which are inclined relative to the longitudinal slots so that the leading edges function as lead-ins to the longitudinal slots. More specifically, each of the side edges 208 extends in a first direction, and the slot leading edges 203 extend in a direction approximately perpendicular to the respective side edge so that the leading edges extend upwardly and forwardly/rearwardly relative to the longitudinal axis of the blade. Said another way, the slots 205 extend generally horizontally, and the slot leading edges extend upwardly and transversely relative to their respective slot 205. Accordingly, the slot leading edges may be inclined relative to a horizontal plane between 1° and 89°, and, in some embodiments, may be inclined at an angle of approximately 45°. Such an arrangement ensures the longitudinal slots are properly engaged and orientated relative to a lifter as the lifter is brought into engagement with the longitudinal slot. The blade also includes a support hole 204 sized and shaped to receive the support 104 on the carrier. The blade further includes a notch 201 configured to receive blade holders (see FIG. 22) which stabilize and maintain the position of the blade inside of a blade cartridge.

Figure 14:
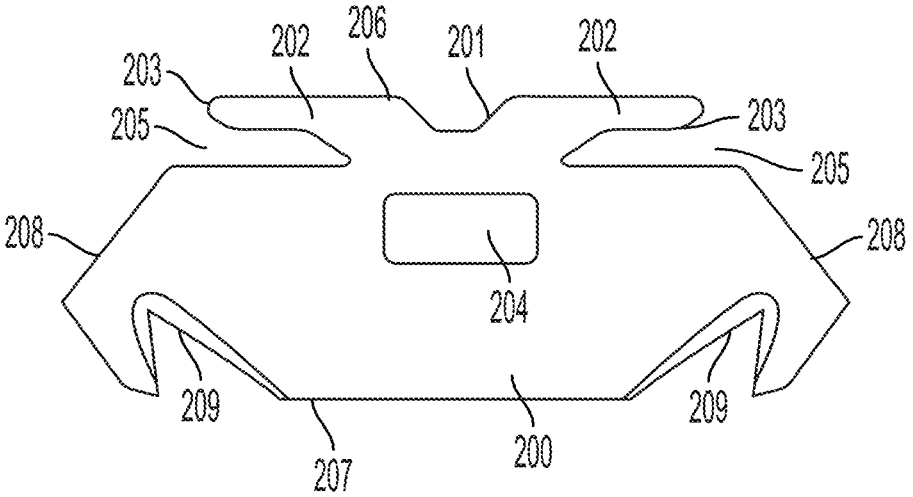
FIG. 14 is a side view of another embodiment of a blade.

FIG. 14 is a side view of another embodiment of a blade 200. Blade 200 of FIG. 14 is largely similar to the blade of FIG. 13, except for the arrangement of the lower edge 207. Rather than a continuous straight edge as in FIG. 13, the blade of FIG. 14 includes two hook blades 209 disposed adjacent opposite side edges 208 of the blade 200. The hook blades may be well suited for cutting thick materials.

According to the embodiments of FIGS. 13-14, the blades 200 are reversible and are mirrored across a vertical centerline. That is, the blades may be used in a utility knife with either of the side edges 208 facing forward. When a first side of the blades is used, the blade may be flipped and used on the second side.

Figure 15:
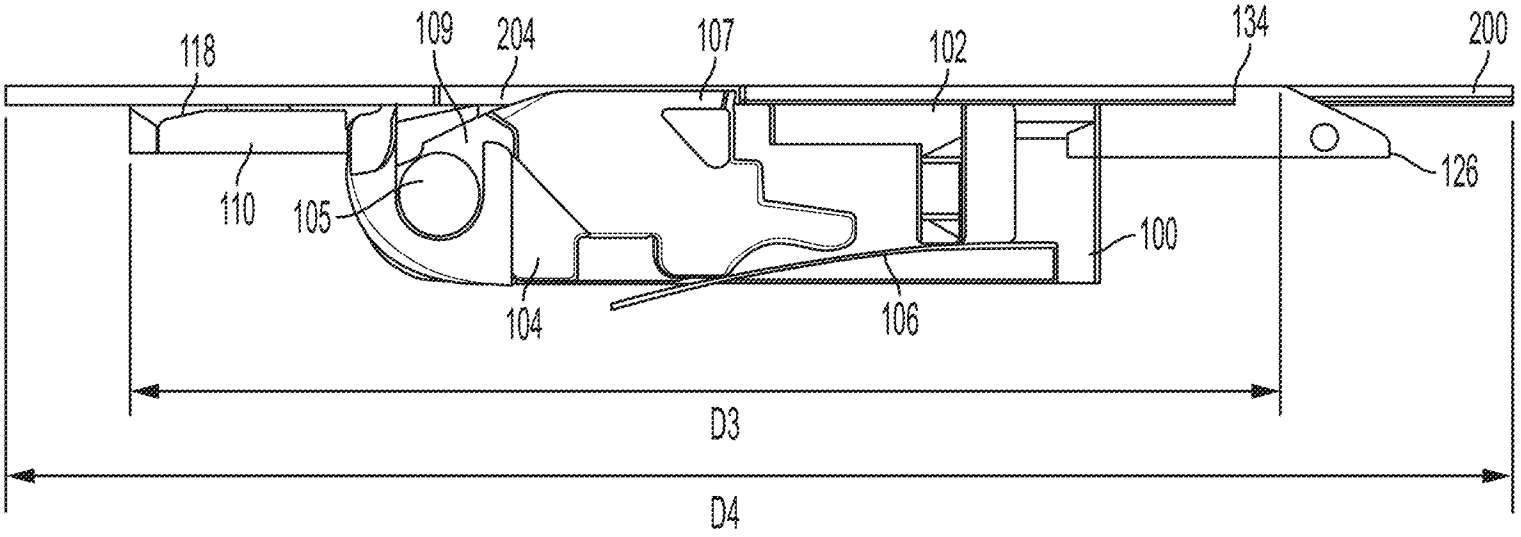
FIG. 15 is a top cross-sectional view of the carrier of FIG. 12 taken along line 15-15 of FIG. 12 and one embodiment of a blade.

FIG. 15 is a top cross-sectional view of the carrier 100 of FIG. 12 taken along line 15-15 and one embodiment of a blade 200 showing engagement of the blade and a blade contact surface 102. As shown in FIG. 15, the blade 200 is disposed on and parallel with blade contact surface 102. Support hole 204 is aligned with support 104 such that the support spring 106 has moved the support into engagement with the support hole. Accordingly, force may be transmitted between the carrier and the blade in a first direction via support engagement surface 107 which contacts the support hole 204. However, force may not be transmitted from the support to the blade in a direction opposite the support engagement surface 107 as support ramp is shaped so that the support is rotated out of engagement with the support hole 204 when the support ramp contacts the support hole. That is, the support rotates about support hinge 105 against the biasing force of the support spring so that the support releases the support hole when the carrier is moved toward a front portion of the engaged blade. Such an arrangement may be beneficial to easily eject and deposit a blade in a used blade compartment. According to the embodiment of FIG. 15, a lifter of the carrier is also engaged with a longitudinal slot of the blade, and a pusher portion 134 of the carrier may be used to move the blade in a second direction (i.e., toward a front portion of the blade). Accordingly, when both the lifter and support 104 are engaged with the blade 200, the blade may be moved in either direction along a blade travel path (i.e., forwards or backwards).

As shown in FIG. 15, the carrier extension 110 supports the blade 200 and extends the blade contact surface 102. As discussed above, the extension includes a beveled surface 118 which is inclined relative to the blade contact surface which guides the blade onto the blade contact surface when the extension 110 contacts an edge of a blade. In FIG. 15, the blade contact surface contacts the blade a first longitudinal distance D3, whereas the overall dimension of the blade is a second longitudinal distance D4. In this embodiment, the distance D3 is greater than or approximately equal to 75% of the distance D4, so that bending of the blade which might move the blade out of parallel with the blade contact surface is mitigated. Of course, the blade contact surface may contact the blade along any suitable longitudinal distance, including, but not limited to 40%, 50%, 60%, or 70% of the total blade length D4.

Figure 16:
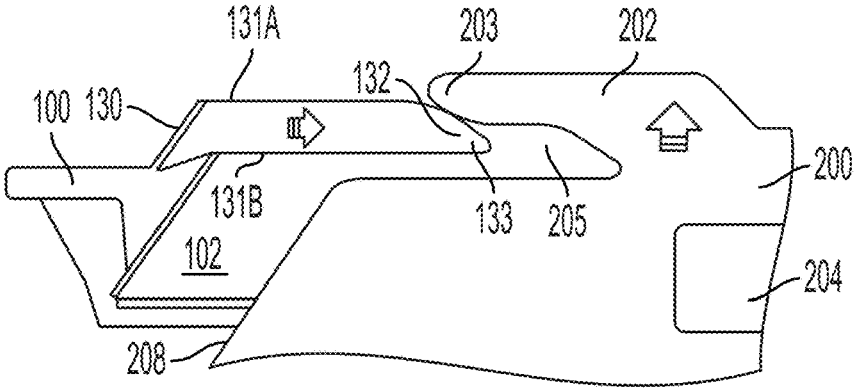
FIG. 16 is an enlarged side view of one embodiment of a carrier and a blade.

FIG. 16 is an enlarged side view of one embodiment of a carrier 100 and a blade 200 showing lifter 130 and blade slider 202 engagement. As shown in the embodiment of FIG. 16, the lifter includes parallel upper and lower surfaces, 131A, 131B with a lifter leading edge disposed therebetween. The engagement of FIG. 16 may occur when the carrier 100 is moved to pick up a new blade from a new blade compartment. As shown in FIG. 16, the lifter leading edge 132 is brought into engagement with longitudinal slot leading edge 203. Accordingly, the blade is lifted by the ramped engagement surfaces until the lifter aligns with the longitudinal slot 205. Once the lifter aligns with the longitudinal slot, the blade may be brought into full engagement with the blade contact surface 102 and the support hole 204 engaged by a support. According to the embodiment of FIG. 16, the lifter leading edge 132 is inclined relative to direction of travel of the carrier and is substantially parallel to the slot leading edge 203. Put another way, the lifter includes a leading end 133 which is disposed in a lower half of the lifter (i.e., is disposed below a horizontal centerline of the lifter), so that the lifter leading edge 132 forms a ramp (e.g., a linear ramp) which is angled rearward and upward from the leading end, or, alternatively, a ramp which is angled forward and downward from an upper surface of the lifter. The lifter leading edge may be inclined relative to the horizontal centerline by an angle of approximately 30°. Such an arrangement ensures reliable lifting and alignment of the lifter with the longitudinal slot. Of course, other angles of inclination of the lifter leading edge 132 may be employed, including, but not limited to, angles less than or approximately equal to 15°, 25°, 35°, 45°, and 55°, as the present disclosure is not so limited.

Figure 17:
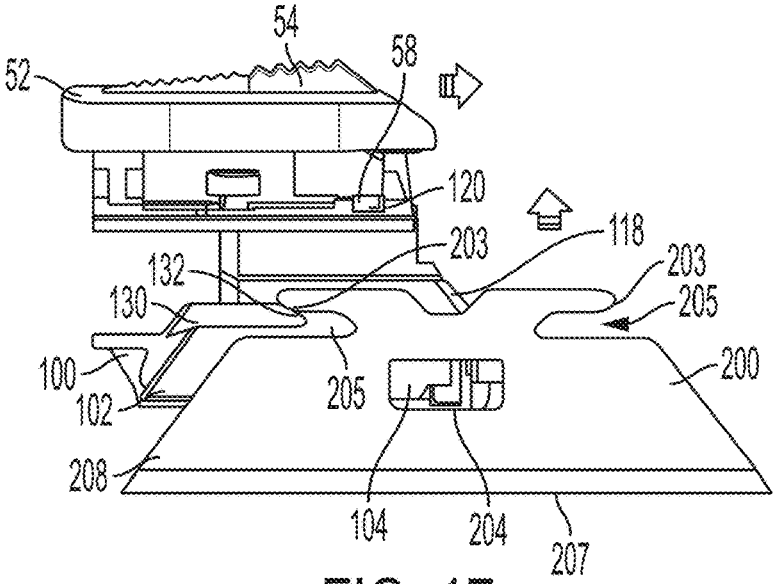
FIG. 17 is a side view of the carrier and blade of FIG. 16 in a first position.

FIG. 17 is a side view of the carrier and blade of FIG. 16 in a first position corresponding to the position shown in FIG. 17 where the lifter 130 is engaging the longitudinal slot leading edge 203 to lift and align the blade 200. More specifically, the lifter leading edge 132 which is inclined relative to a direction of travel of the carrier engages the slot leading edge so that continued movement of the carrier towards the blade lifts the blade. As shown in FIG. 17, the support 104 is overlapping with the support hole 204 but is not aligned sufficiently to engage the support hole.

Figure 18:
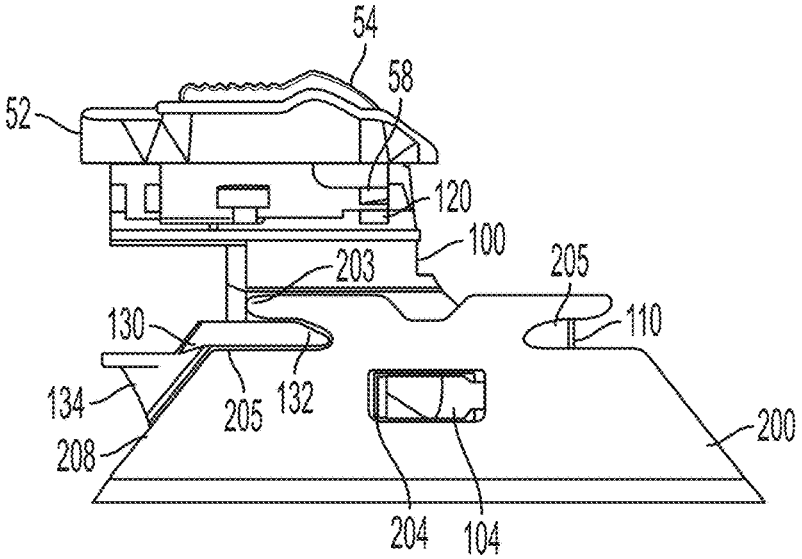
FIG. 18 is a side view of the carrier and blade of FIG. 16 in a second position.

FIG. 18 is a side view of the carrier 100 and blade 200 of FIG. 16 in a second position where the blade is fully engaged with the carrier. As shown in FIG. 18, the support 104 is engaged with the support hole 204 so that the blade is supported by the support. Additionally, the lifter 130 has been fully received into the rear longitudinal slot 205 of the blade 200. The longitudinal slot 205 has a size and shape equivalent to that of the lifter, including a triangularly shaped end configured to receive the ramped leading edge 132 of the lifter, so that when the lifter is fully disposed in the longitudinal slot the lifter supports the blade and maintains its orientation. Accordingly, in the position shown in FIG. 18, operation of the push button assembly by a user may be used to move the blade 200 along a travel path to extend the blade, retract the blade, or deposit the blade in a used blade compartment.

Figure 19:
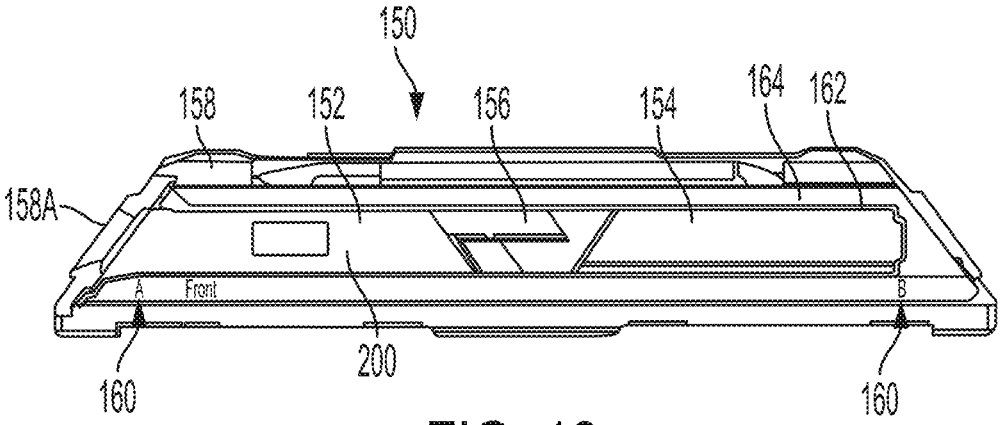
FIG. 19 is a first side view of one embodiment of a blade cartridge.
Figure 20:
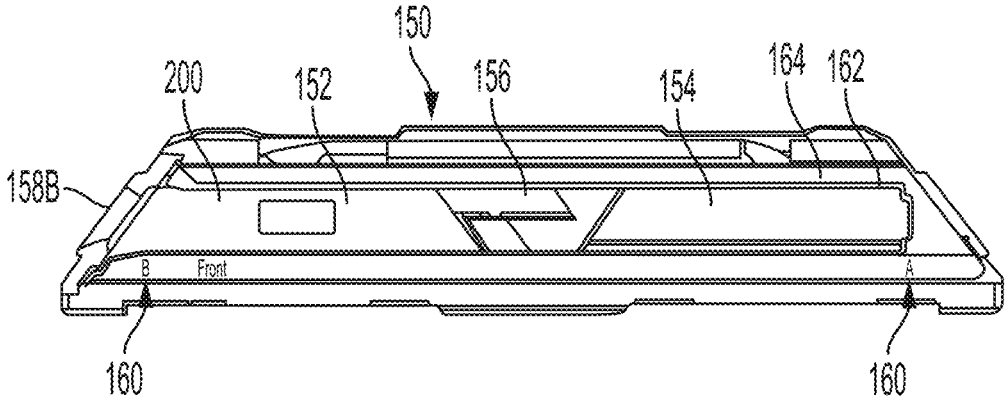
FIG. 20 is a second side view of the blade cartridge of FIG. 19.

FIG. 19 is a first side view and FIG. 20 is a second side view of one embodiment of a blade cartridge 150. As discussed above, the blade cartridge includes a new blade compartment 152 and a used blade compartment 154 which are separated by a cartridge insert 156. According to the embodiment of FIG. 19, the blade cartridge is mirrored across a central longitudinal axis and a central vertical axis, yielding a cartridge with a substantially symmetrical cartridge housing 158. The cartridge housing is split into a first half 158A and a second half 158B which are joined along a parting line (for example, see FIG. 26-27). The cartridge also includes a cartridge slot 162 through which the blades may be contacted (e.g., by a spring) and a cartridge rail 164 which may at least partially guide or support a carrier.

According to the embodiment of FIGS. 19-20, the new and used blade compartments 152, 154 may be reversible so that the used blade compartment becomes the new blade compartment once all of the blades 200 are moved from the new blade compartment to the used blade compartment. Such an arrangement may be employed to ensure both sides of the blades may be used before the cartridge is discarded. Accordingly, the cartridge may be arranged so that regardless of which end of the cartridge is oriented towards the front of the knife, the cartridge and knife may cooperate to allow blades to be moved from the new blade compartment to the used blade compartment. As shown in FIGS. 19-20, the cartridge includes cartridge indicators 160 which denote the end of the cartridge and allow a user to easily see which end of the cartridge is oriented toward the front of a knife. Such information may be useful so that a user knows how many fresh blades may be remaining while placing the cartridge in the knife. In some embodiments, the indicators may be aligned with a window formed on a knife housing, as will be discussed further with reference to FIGS. 30-32.

Figure 21:
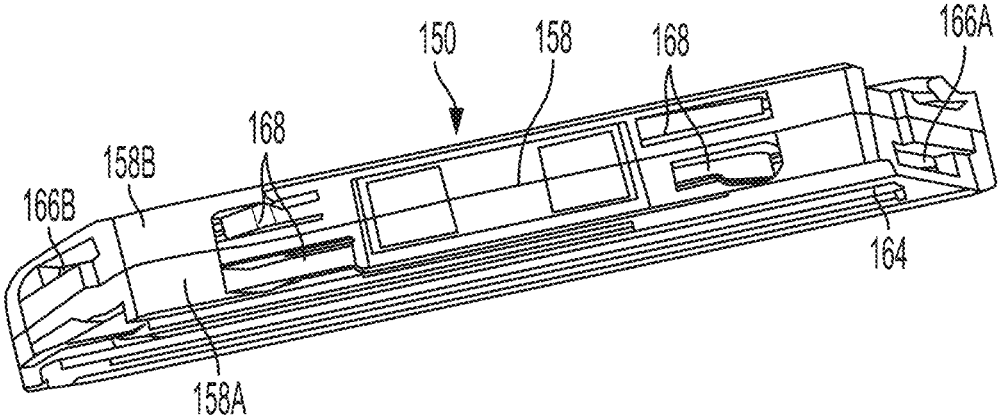
FIG. 21 is a perspective view of the blade cartridge of FIG. 19.

FIG. 21 is a perspective view of the blade cartridge 150 of FIG. 19, showing the mirrored arrangement of the first housing half 158A and second housing half 158B. The first housing half 158A includes a first blade slot 166A and the second housing half includes a second blade slot 166B. The first and second blade slots define a travel path for the blades disposed in the new blade compartment. The blade slots align with an opening formed in a knife housing and function as the sole exits for the blades disposed in the cartridge. Depending on which end of the blade cartridge is oriented toward the front of a knife, the first blade slot or second blade slot may be used to move blades to an extended position. According to the embodiment of FIG. 21, the blade cartridge also includes blade holders 168 which define the blade compartments and ensure the blades are and oriented corrected in the blade slots. The blade holders may engage a notch formed in the upper edge of the blades, although other arrangements are possible.

Figure 22:
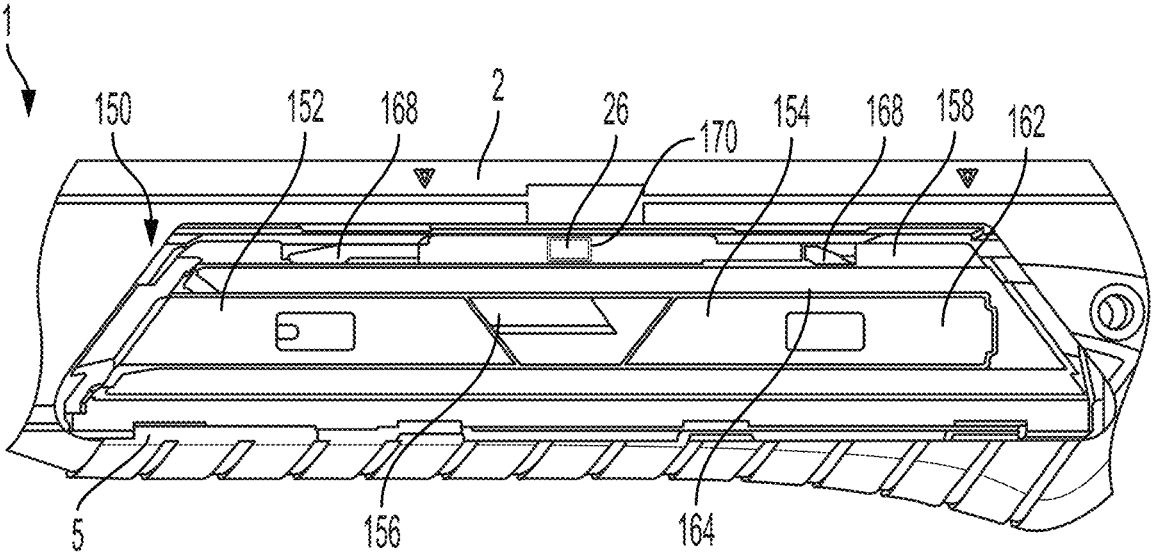
FIG. 22 is a side view of another embodiment of a blade cartridge disposed in a knife.

FIG. 22 is a side view of another embodiment of a blade cartridge 150 disposed in a knife 1. In the embodiment of FIG. 22, the cartridge includes a retaining channel 170 configured to receive an alignment post 26 of the knife which is disposed in a cartridge receptacle 5. The alignment post is configured to guide and orient the cartridge in the cartridge receptacle, so that the cartridge and blades disposed therein may be reliably engaged by a carrier. In the embodiment of FIG. 22, the alignment post has a rectangular shape which tightly or otherwise suitably fits into a correspondingly shaped retaining channel. When the alignment post is disposed in the retaining channel, the cartridge is inhibited from moving longitudinally and/or rotating in the cartridge receptacle, so that the cartridge remains stationary or otherwise suitably positioned relative to the knife housing 2 when the knife is operated. Accordingly, the cartridge receptacle 5 may be shaped with lower tolerances as the alignment post maintains the correct position of the cartridge in the knife. Additionally, the alignment post does not inhibit a user from easily removing the cartridge for replacement. In some embodiments, the cartridge receptacle 5 may include one or more biased retaining catches configured to releasably retain the cartridge in the cartridge receptacle. The biased retaining catches may be deflected as the cartridge is inserted into the cartridge receptacle and snap into place to retain the cartridge in the cartridge receptacle. The biased retaining batches may be manually released by a user so that the cartridge may be removed.

Figure 23:
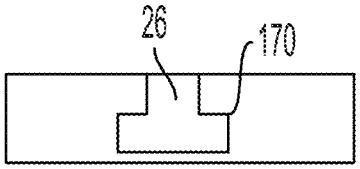
FIG. 23 is a schematic of one embodiment of an alignment post and retaining channel.

In some embodiments, the alignment post 26 may be shaped and the retaining channel 170 correspondingly shaped so that movement of the cartridge in at least four directions is resisted by the alignment post. For example, the alignment post may be "T"-shaped so that at least four surfaces are engaged, as shown in FIG. 23. In such an arrangement the alignment post may inhibit the cartridge from translating in a vertical direction (e.g., up or down), translating in a longitudinal direction (e.g., forward or rearward), or rotating about an axis defined by the alignment post. Accordingly, such an arrangement could inhibit movement of the cartridge relative to the knife in at least five directions, four of which are translational directions. Of course, any suitable shape may be employed for the alignment post and retaining channel for inhibiting movement of the cartridge in any desirable direction, as the present disclosure is not so limited.

Figure 24:
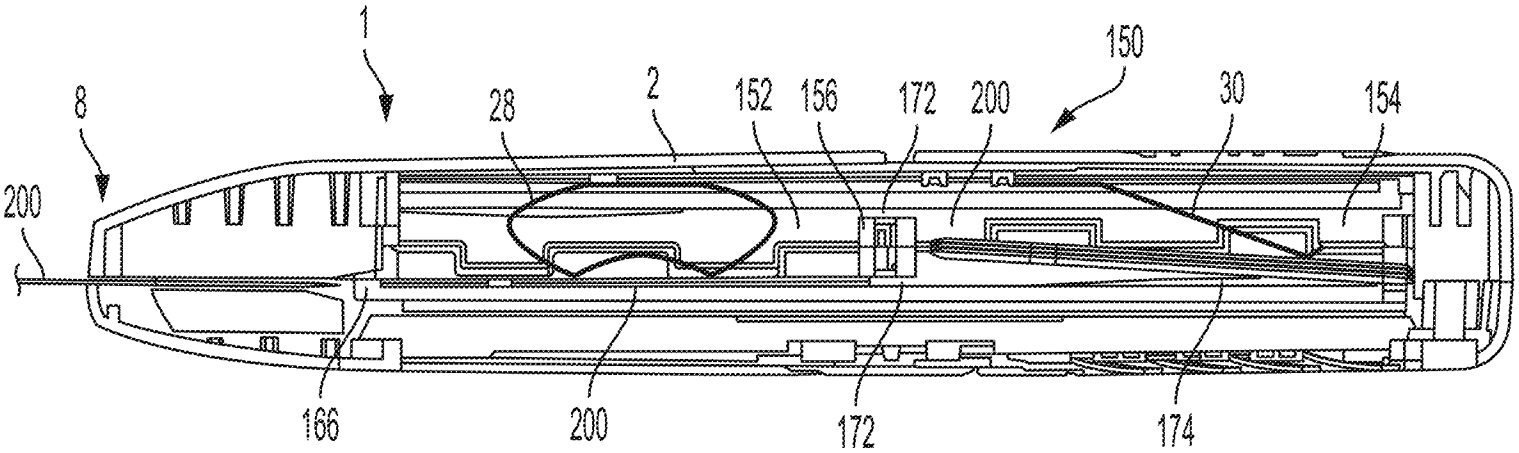
FIG. 24 is a top internal view of one embodiment of a utility knife and blade cartridge.

FIG. 24 is a top internal view of one embodiment of a utility knife 1 and blade cartridge 150 showing the arrangement of a front spring 28 and a rear spring 30. The front spring 28 is aligned with a new blade compartment 152 and the rear spring is aligned with a used blade compartment 154. The front spring is configured to bias blades 200 disposed in the new blade compartment toward alignment with a blade slot 166. With the blades biased towards the blade slot, individual blades may be easily picked up by the carrier and moved to extend out of a front portion 8 of the knife. The front spring 28 is configured as a closed spring and has two contact patches with the blade stack disposed in the new blade compartment. Accordingly, the front spring applies even pressure across the two contact patches which urges the blades 200 towards alignment with a planar travel path 172 defined in part by the blade slot 166. The rear spring 30, in contrast, is an open spring configured to apply biasing force to a single contact patch. The rear spring applies pressure to the blade stack in the used cartridge are a region where the blades are disposed on a used blade ramp 174. As the used blade ramp is inclined relative to the travel path 172, the blades 200 in the used blade compartment are kept parallel to the used blade ramp and angled relative to the travel path. Such an arrangement ensures the blades in the used blade compartment do not interfere with additional blades entering the used blade compartment.

Figure 25:
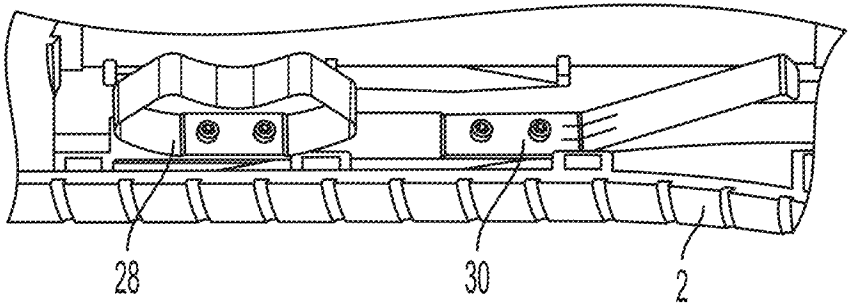
FIG. 25 is an enlarged perspective view of one embodiment of front and rear springs for a utility knife.

FIG. 25 is an enlarged perspective view of one embodiment of front 28 and rear 30 springs for a utility knife. As discussed above, the front spring is a closed spring which applies even force to a blade stack so that the blades are kept in alignment with a travel path in a new blade compartment. In contrast, the rear spring is an open spring configured to apply force to a blade stack at a single contact patch so that the blades in the used blade compartment are angled relative to the travel path and held out the way of additional blades entering the used blade compartment. Of course, while the front spring is closed and the rear spring is open in the embodiment of FIG. 25, any suitable spring shape may be employed to apply a biasing force to blades in either the new or used blade compartments, as the present disclosure is not so limited.

Figure 26:
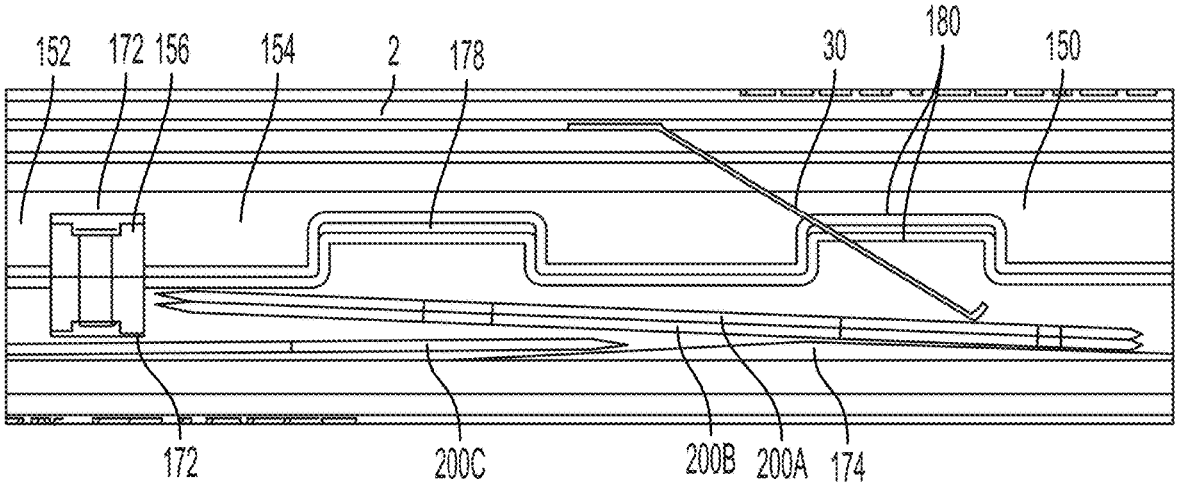
FIG. 26 is a top view of one embodiment of a used blade compartment of a blade cartridge in a first state.
Figure 27:
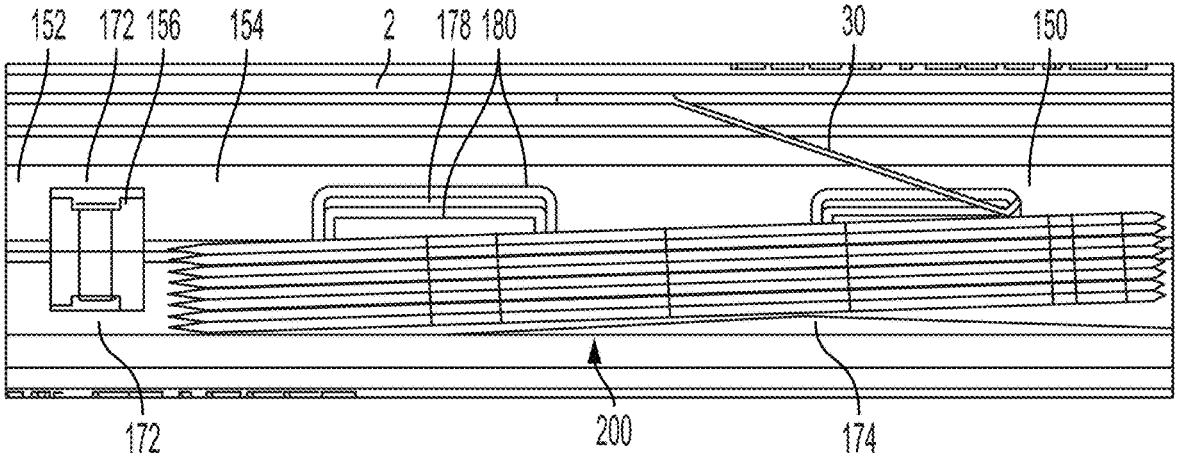
FIG. 27 is a top view of the used blade compartment of FIG. 26 in a second state.

FIGS. 26-27 are a top view of one embodiment of a used blade compartment 154 of a blade cartridge 150 in a first and second state, respectively. FIGS. 26-27 illustrate a fractional top view of cartridge used blade compartment 154 which is half the total length of the cartridge 150. The fractional view of cartridge insert 156 separates used blade compartment 154 from new blade compartment 152. The total length of the cartridge 150 includes two separate halves joined by irregular parting line 178. The non-linear parting line 178 inhibits lower blade edges from getting caught in what would otherwise be a straight parting line. This illustration shows blade 200A, the first blade to enter the used blade compartment, which proceeded on blade path 172. Blade 200A moved up cartridge used blade ramp 174, which is a molded section of the interior configuration of cartridge 150. Blade 200A then slipped under rear spring 30, which rotated the leading section of blade 200A over a peak of ramp 174. The pressure of the rear spring 30 forced blade 200A to rest on the downward angle on the rear of ramp 174, which moved the trailing end of blade 200A up and clear of other incoming blades. Blade 200B followed the same procedure as blade 200A as it slipped under blade 200A. Incoming blade 200C in blade path 172 is shown beginning to proceed up ramp 174 to slide under blade 200B while the pressure of rear spring 30 continues to hold the leading portion of all blades in the used blade compartment down on the rear angle of ramp 174. This same incoming used blade procedure is used until all incoming blades are secured in used blade compartment 154.

As shown in FIG. 26, the parting line 178 includes a beveled edge radii 180 on both sides of parting line 178. The beveled edge radii inhibit snagging of blades 200 as they rotate on cartridge 150 floor over parting line 178 and beveled edge radii 180. Such an arrangement ensures a smooth transition of blades to a used blade compartment with no interference from used blades already disposed in the used blade compartment.

Figure 28A:
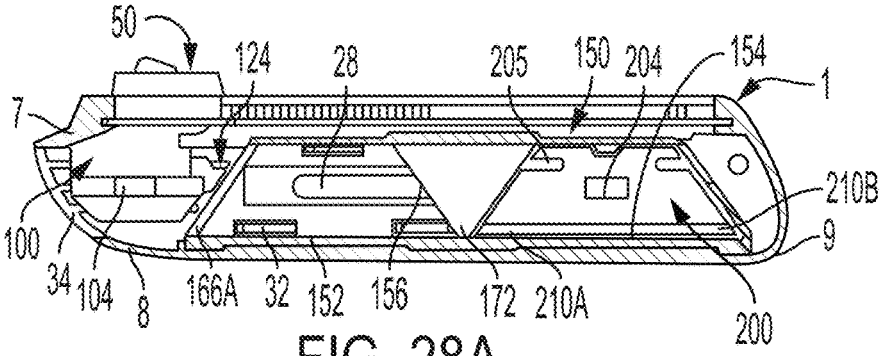
FIG. 28A is a side view of one embodiment of a utility knife in a first position.

In FIGS. 28A-28E, a knife 1 is shown with various positions of the carrier 100 that allow the cartridge 150 to be replaced and that sequentially move new blades from the new blade compartment 152 to the operative position, retracted position and finally to the used blade compartment 154 when each worn blade requires replacement. In FIG. 28A the cartridge 150 is shown with all of the blades 200 in the rear or used blade compartment 154—no blades are in the front new blade compartment 152. In this situation, the cartridge 150 may either be replaced when both sides 210A, 210B of each blade 200 have been used, or reversed with the compartment 154 at the front of the housing when just one side of each blade is worn. To reverse or replace the cartridge, the carrier 100 may be moved to the front of the housing 8 fully detached from and out of the cartridge 150 as shown in FIG. 28A. If the cartridge 150 of FIG. 28A is reversed, used blade compartment 154 would be disposed at the front end of the housing and new blade compartment 152 would be disposed at the rear. As a result, all of the blades 200 in compartment 154 would be disposed at the front end 8 of the housing 7 with the unused ends 210B of the blades at the front end of the housing, and the compartment 152 at the rear would again be empty. The same, of course, would be true if the cartridge 150 were replaced with a new one.

Figure 28B:
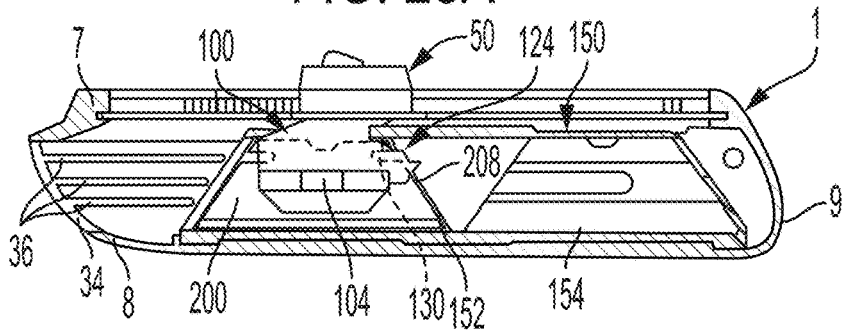
FIG. 28B is a side view of the utility knife of FIG. 28A in a second position.
Figure 28C:
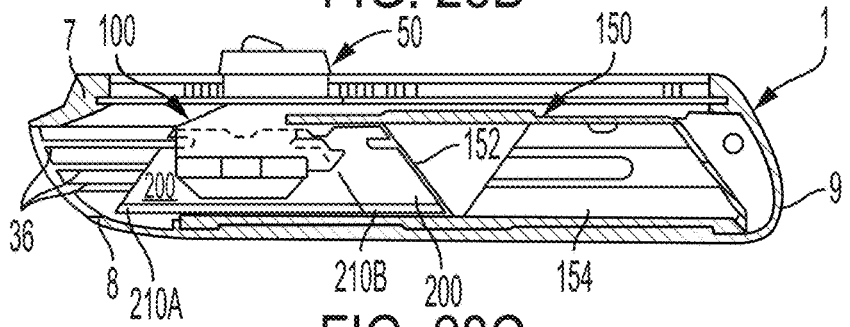
FIG. 28C is a side view of the utility knife of FIG. 28A in a third position.

In FIG. 28B the carrier 100 is shown in position to engage the first blade 200 in the front compartment by means of the support 104 and the lifter 130 of the carrier as described above. The lifter 130 engages a rear longitudinal slot in the rear side edge 208 of the blade. When the blade is engaged in that fashion, the carrier may be moved towards the front end 8 of the housing and that motion carries the blade with it toward the blade opening 34 in the knife 1. In FIG. 28C, the blade 200 is shown partially removed from the front compartment 152 of the cartridge, but is contained fully within the knife 1, and in FIG. 28D the blade 200 is shown in its operative position extending almost entirely out of the cartridge 150 and its leading cutting edge 210A is fully exposed beyond the blade opening 34 in the knife. In the position shown in FIG. 28D, the blade 200 is partially supported by blade guides 36 which define the blade opening 34. The carrier 100 pushes the blade 200 as it moves toward the back end 9 of the knife by virtue of the engagement of the squared edge of the support 104 with the rear edge of the hole 204 in the blade. It should be noted that to move the blade from one position to another, the push button assembly may be in the unlocked position, as discussed above. However, when the blade 200 is not to move such as when it is in use, the push button assembly is locked under biasing force (e.g. from a pusher spring) so as to inhibit the carrier 100 from moving.

Figure 28D:
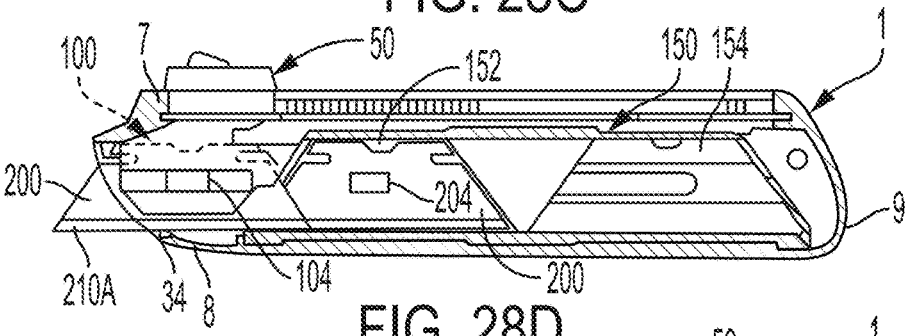
FIG. 28D is a side view of the utility knife of FIG. 28A in a fourth position.
Figure 28E:
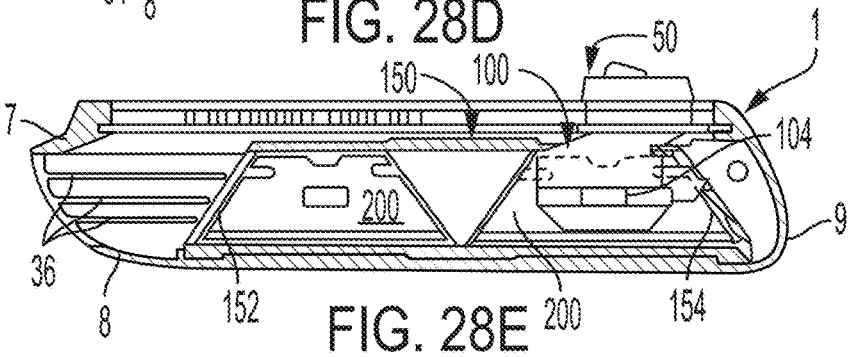
FIG. 28E is a side view of the utility knife of FIG. 28A in a fifth position.

If the forward cutting edge 210A of the blade 200 is not worn and the knife is not to be used for a period of time, the carrier 100 may be returned to the position shown in FIG. 28C and the push button assembly 50 can be locked so that the blade 200 and particularly its leading edge 210A is fully contained within the knife so as not to be exposed. When the utility knife is to be used again, the carrier 100 may again be moved in a forward direction by unlocking the push button assembly, so as to expose the working end 210A of the blade as shown in FIG. 28D. When the utility blade forward cutting edge 210A is no longer suitable for performing its intended cutting function, the blade 200 is moved to the rear used blade compartment 154 by sliding the push button assembly 50 and carrier 100 to the position shown in FIG. 28E. In this manner, the blade 200 is deposited in the rear used blade compartment 154, and the carrier 100 may then be moved forward to the position shown in FIG. 28B to pick up the next blade in the front or new blade compartment. The carrier 100 may be locked in any one of the positions illustrated in FIGS. 28A-28E by the mechanism provided in the push button assembly.

Figure 29:
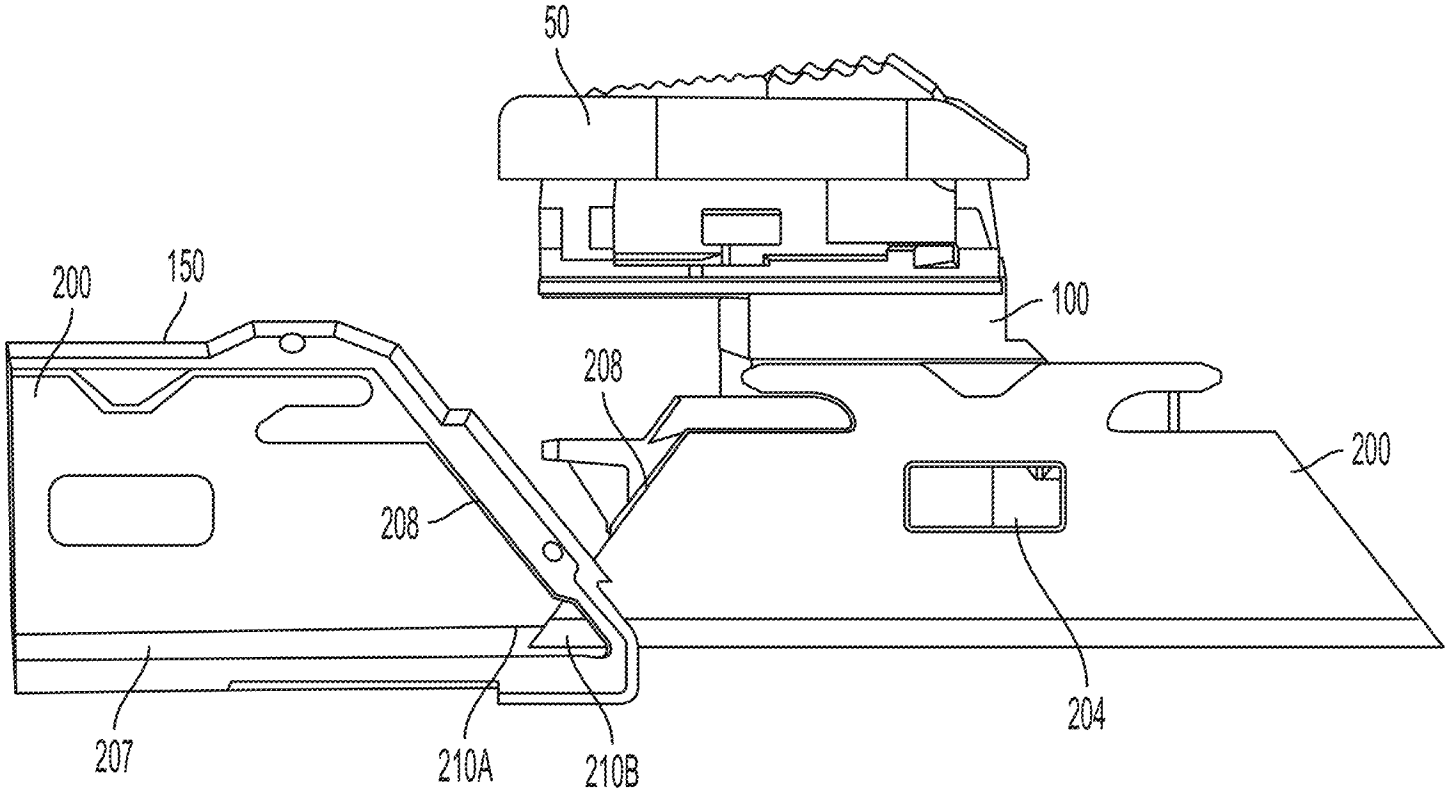
FIG. 29 is an enlarged side view of one embodiment of a carrier and blade cartridge.

FIG. 29 is an enlarged side view of one embodiment of a carrier 100 and blade cartridge 150 demonstrating how a blade is extended while ensuring the blade may be retracted and subsequently moved to a used blade compartment. As shown in FIG. 29, a blade is engaged by the carrier 100 and projects out of the cartridge 150 so that a leading edge of the blade may be exposed for cutting work. However, the trailing cutting edge 210B remains disposed in the cartridge overlapping with a leading edge of the next blade disposed in the new blade compartment. Accordingly, even if the blades in the new blade compartment are biased toward the extended blade, the blades will not block the extended blade from retracting as the trailing edge 210B is disposed between the leading edge 210A of the next blade and the cartridge.

Figure 30:
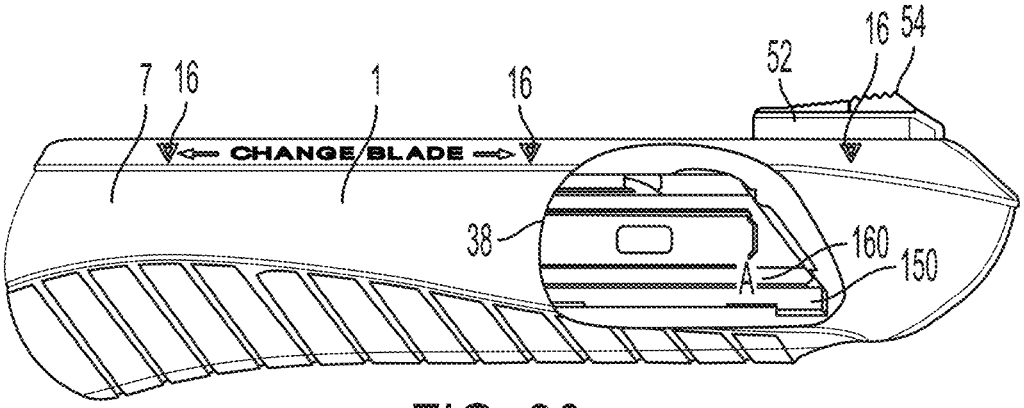
FIG. 30 is a cutaway side view of one embodiment of a utility knife and blade cartridge.
Figure 31:
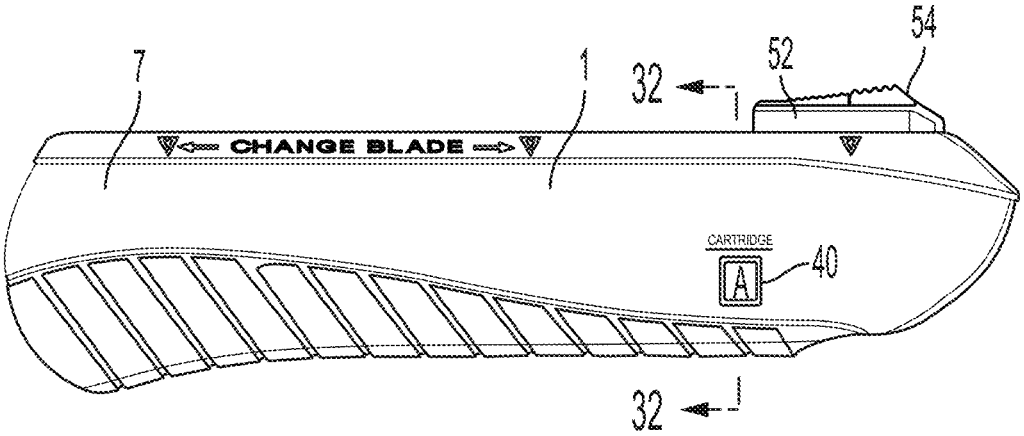
FIG. 31 is a side view of the utility knife and blade cartridge of FIG. 30.

FIG. 30 is a cutaway side view of one embodiment of a utility knife 1 and blade cartridge 150. As shown through the cutaway 38, the blade cartridge 150 is disposed in the knife and includes a side indicator 160 on the outside of the cartridge 150 which denotes a side of the cartridge. FIG. 31 is a side view of the utility knife and blade cartridge of FIG. 30 showing a side knife window 40 which allows the side indicator 160 to be seen by a user. According to the embodiments to FIGS. 30-31, the utility knife includes a utility knife housing having a front, rear, opposing sides, a top, and a bottom. The side knife window 40 of FIG. 31 is formed on one or both of the opposing sides (e.g., a left or right side of the knife). Of course, in other embodiments, the knife window 40 may be formed on different surfaces of the knife. In one embodiment, the knife window may be formed on the rear of the knife and correspondingly the indicator may be disposed on longitudinal ends (e.g., front and rear ends) of the cartridge. As noted previously, as the blade cartridge may be flipped so that each end of every blade in the cartridge may be used, the side indicator may be desirable so that a user can quickly determine which side of the cartridge is in use and if the cartridge may be flipped or if the cartridge should be completely replaced. According to the embodiment of FIGS. 30-31, the side indicator may be an alphanumeric character, a color, or a combination of marking and colors which allows a user to ascertain which side of the cartridge is facing forward.

Figure 32:
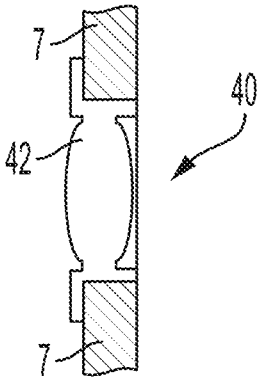
FIG. 32 is a cross-sectional view of one embodiment of a knife indicator window taken along line 32-32 of FIG. 31.

FIG. 32 is a cross-sectional view of one embodiment of a knife side window 40 taken along line 32-32 of FIG. 31. The knife indicator window is disposed in the knife housing 7 and is formed as a magnifying lens 42 which magnifies the side indicator or marking disposed on the cartridge. Such an arrangement ensures even a small marking on the cartridge may be visible to a user of the knife.

Figure 33:
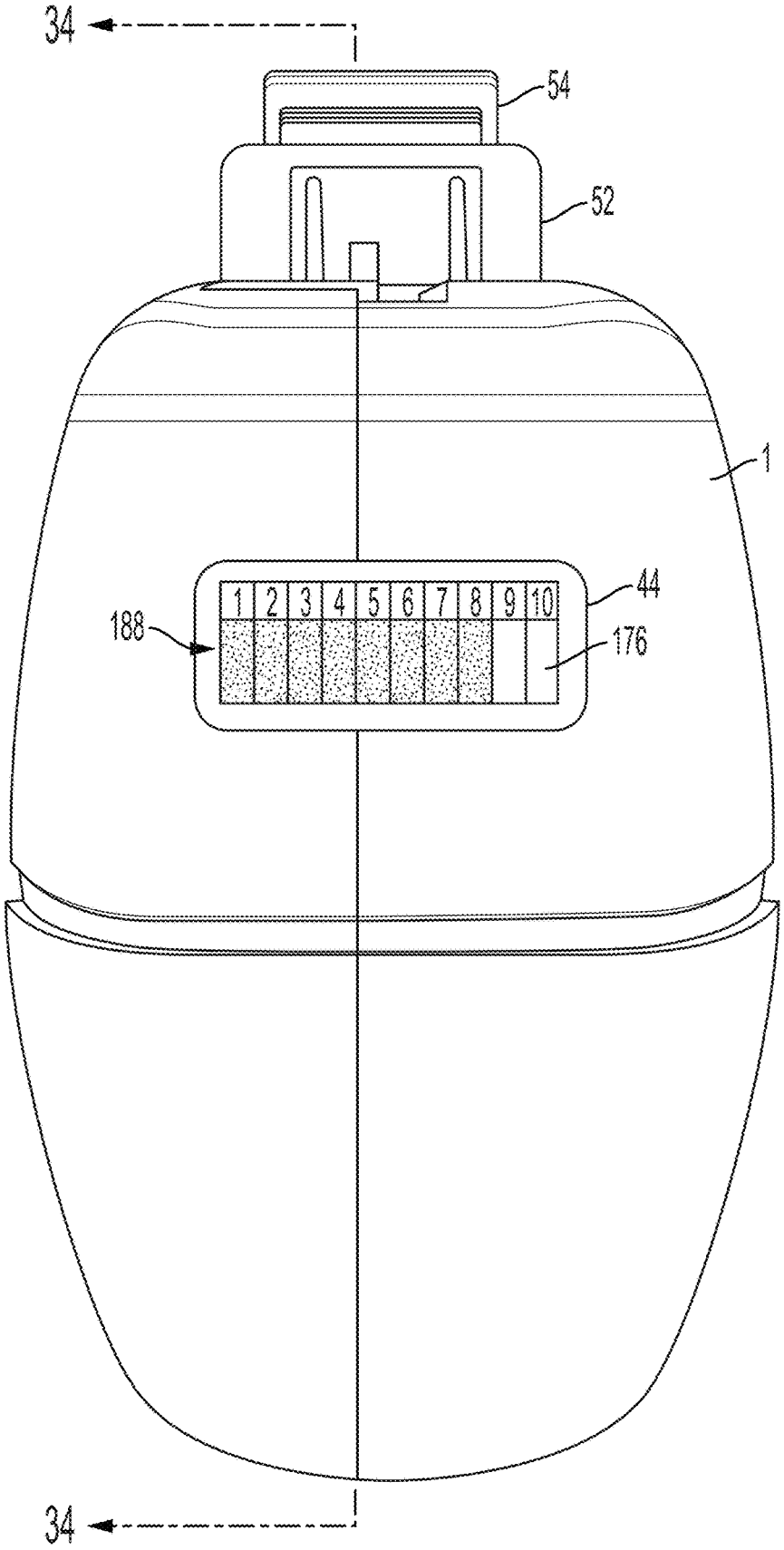
FIG. 33 is a rear view of one embodiment of a knife including a knife window.

FIG. 33 is a rear view of one embodiment of a knife including a knife window 44 which allows a user to view a cartridge blade window 176 formed on an end of the cartridge. That is, the knife window is disposed on a rear longitudinal end of the knife, and likewise the blade window is formed on a longitudinal rear end of the blade cartridge. The cartridge blade window allows a user to view into the used blade compartment of the cartridge to see a number of blades disposed in the used blade compartment. More specifically, the blade window allows a user to view left or right side edges (e.g., longitudinal ends) of the blades disposed in the cartridge. Put another way, the blade window provides a view in a direction along (i.e., parallel with) planes defined by each of the blades. A window diagram or graphic 188 disposed on the cartridge blade window or the knife window allows a user to easily see and/or count how many blades are disposed in the used blade compartment. As the total number of blades in the cartridge is predetermined, a user may use the information from knife window to determine how many blades remain for use in a new blade compartment. In some embodiments, the blade window may be formed of a transparent plastic, glass, or any other suitable material.

Figure 34:
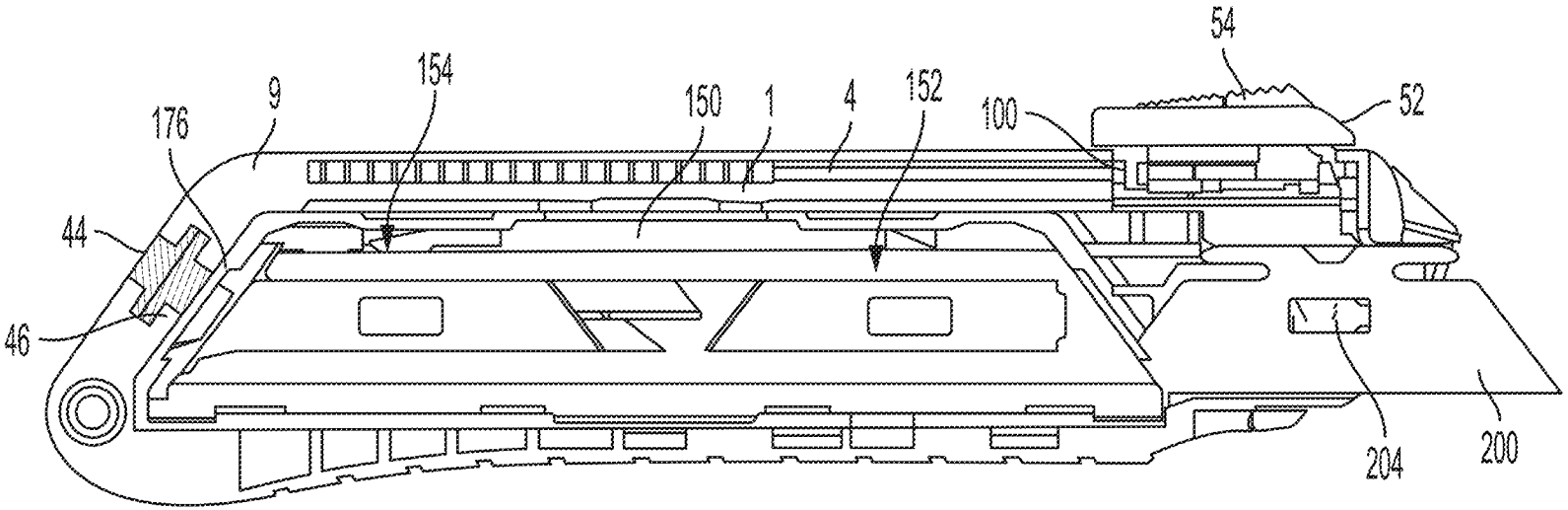
FIG. 34 is a side cross-sectional view of the knife and knife window of FIG. 33 taken along line 34-34 of FIG. 33.

FIG. 34 is a side cross-sectional view of the knife 1 and knife window 44 of FIG. 33 taken along line 34-34. As noted above, the knife window is formed in a rear portion 9 of the knife and is aligned with the cartridge 150 so that a cartridge blade window 176 may be viewed through the knife window. The knife window includes a magnifying lens 46 which enlarges the view of the cartridge blade window, making it easier to see the number of blades disposed in the used blade compartment 154 of the cartridge. The cartridge may include a cartridge blade window disposed on both longitudinal ends of the cartridge so that for either orientation of the cartridge in the knife a user may be able to determine a number of usable blades remaining in the new blade compartment 152.

Figure 37:
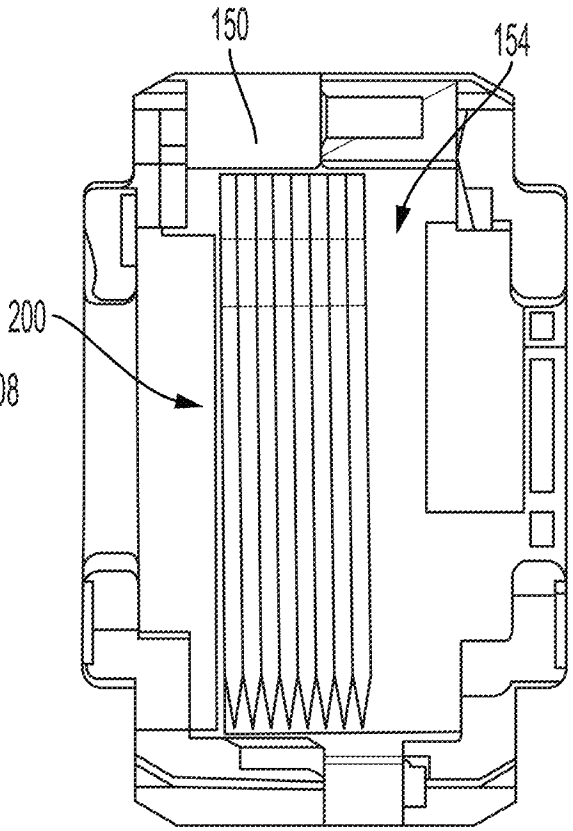
FIG. 37 is an internal view of the blade cartridge of FIG. 35.
Figure 36:
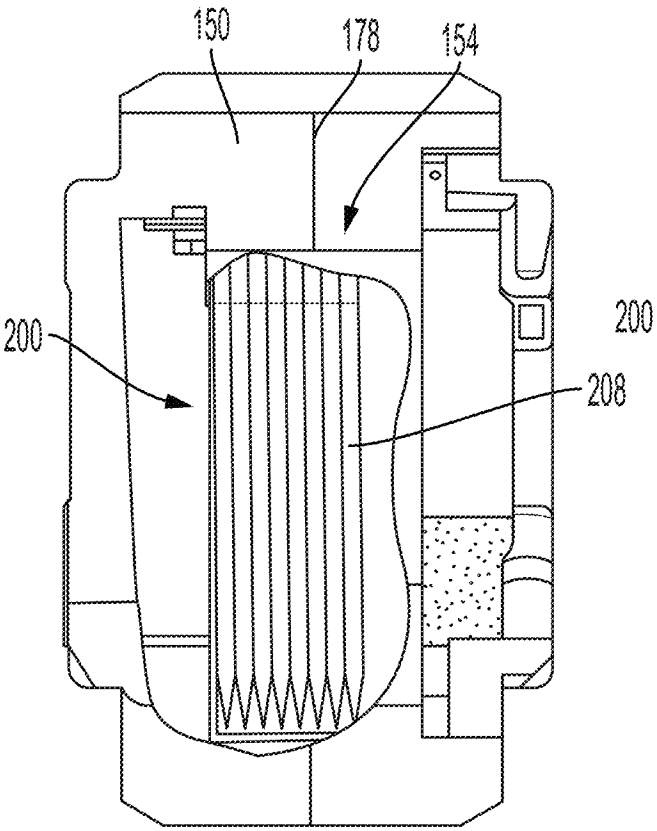
FIG. 36 is a cutaway rear view of the blade cartridge of FIG. 35.
Figure 35:
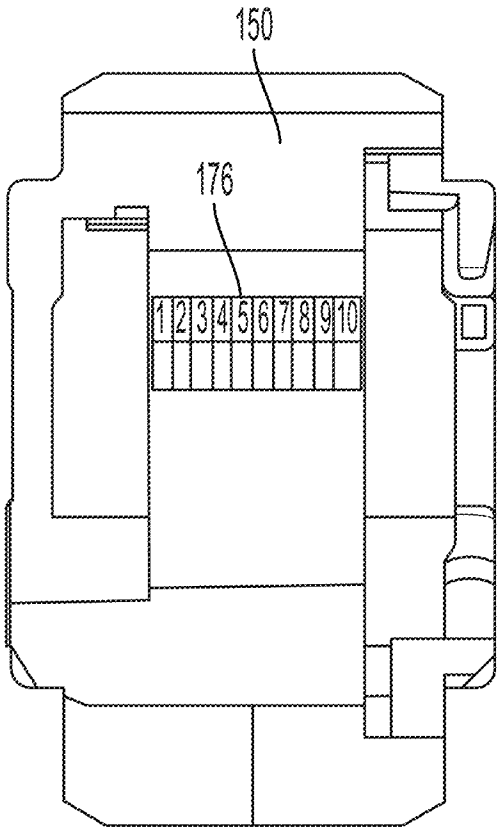
FIG. 35 is a rear view of one embodiment of a blade cartridge with a blade window.

FIGS. 35-37 are a rear view, rear cutaway view, and rear internal view of one embodiment of a blade cartridge 150 with a blade window 176. As shown in FIG. 35, the cartridge includes a blade window 176 formed in the cartridge housing which allows a user to view the inside of the used blade compartment of the cartridge to see how many blades are disposed therein. As shown in FIGS. 36-37, the blades 200 are disposed in the used blade compartment 154. The side edges 208 of the blades are adjacent the blade window and allow a user to count the number of blades in the stack.

Figure 38:
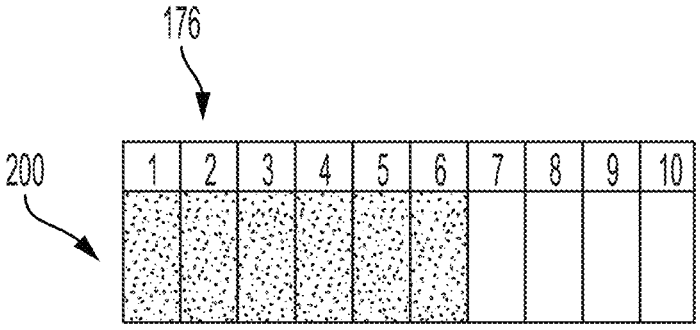
FIG. 38 is a diagram of one embodiment of a blade window.

FIG. 38 is a diagram of one embodiment of a blade window 176. In the embodiment of FIG. 38, the blades 200 are visible as dark objects through the window so that a user may quickly determine how many usable blades are remaining. In FIG. 38, six blades are disposed in the used blade compartment, meaning one blade is engaged and in use and three other blades remain in the new blade compartment. Such information may be desirable for planning a work project so that a user provisions enough blades for the project.

Figure 39:
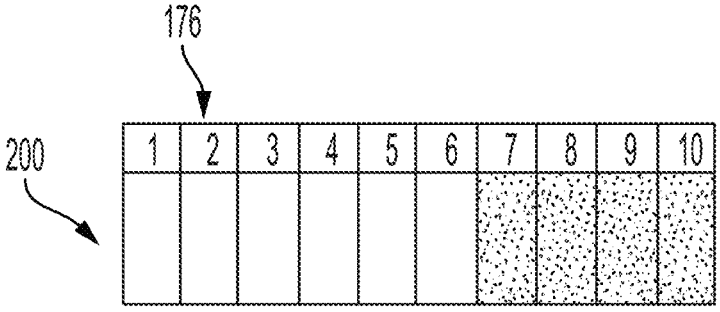
FIG. 39 is a diagram of another embodiment of a blade window.

FIG. 39 is a diagram of another embodiment of a blade window 176. In FIG. 39, the side edges of the blades 200 are rolled with a white or otherwise brightly colored paint. Accordingly, the white or colored ends of the blades are visible through the window 176 and the rest of the used compartment is dark. Like FIG. 39, the window of FIG. 39 indicates six blades are disposed in the used blade compartment and four blades remain ready for use which are engaged by a carrier or disposed in a new blade compartment.

Figure 40:
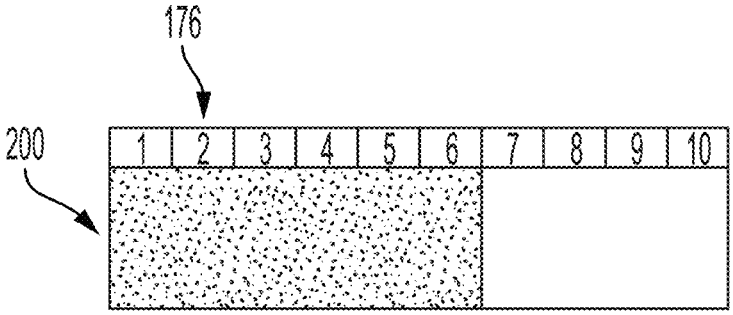
FIG. 40 is a diagram of yet another embodiment of a blade window.

FIG. 40 is a diagram of another embodiment of a blade window 176. The blade window of FIG. 39 lacks the vertical line markings of FIGS. 38 and 39. In some cases, the blades may not align perfectly in a used blade compartment, depending on the tolerances of the cartridge and the blades. Accordingly, the arrangement of FIG. 40 may provide a blade count without confusing the user with any possibly misaligned lines. Like the embodiments of FIGS. 38 and 39, the window of FIG. 40 indicates there are six blades in the used blade compartment.

Figure 41:
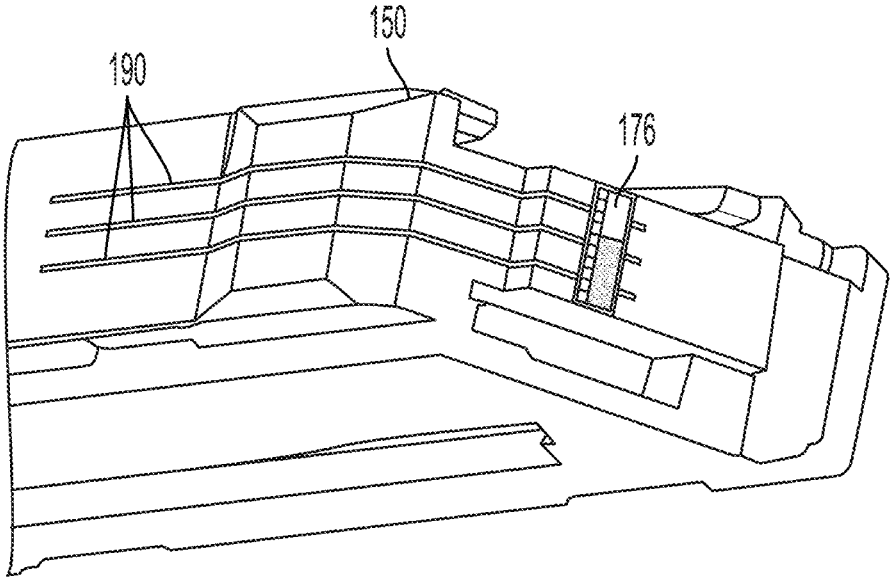
FIG. 41 is a perspective view of another embodiment of a blade cartridge.

FIG. 41 is a perspective view of another embodiment of a blade cartridge 150 including light slots 190 which allow more light into the cartridge for blade illumination. In some cases, a knife housing may significantly block light coming into either of the cartridge compartments where blades are disposed. Accordingly, while a cartridge may include a blade window 176, there may be insufficient illumination to clearly see and count the blades. Accordingly, the light slots 190 are configured to allow light to diffuse in from outside of the knife housing and illuminate the blades so that they may be more clearly seen through blade window 176.

Figure 42:
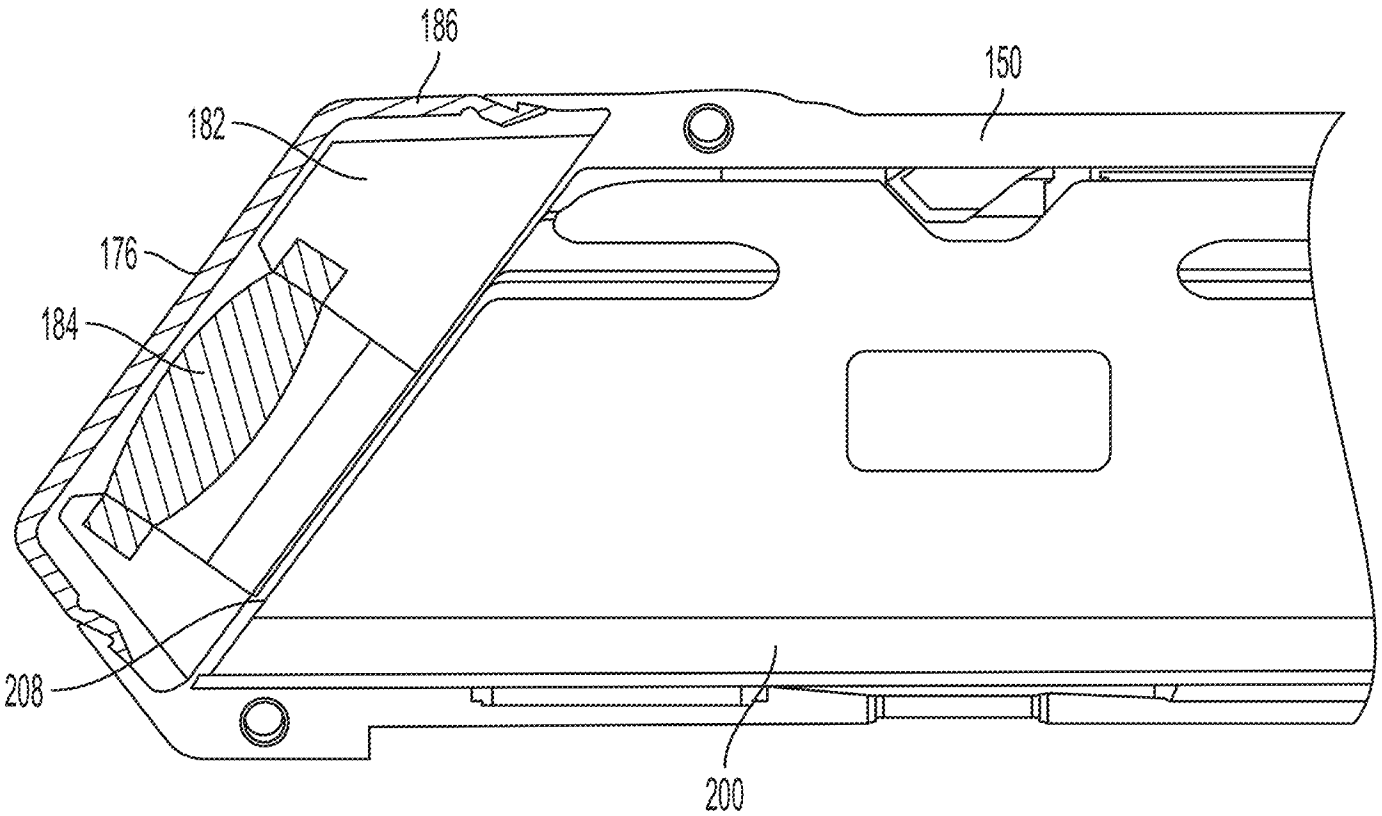
FIG. 42 is an internal side view of another embodiment of a blade cartridge and blade window.
Figure 43:
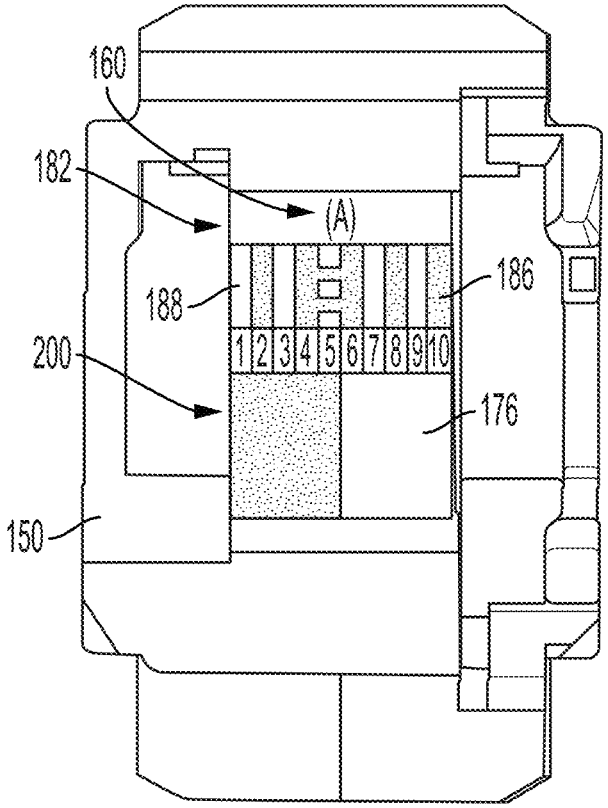
FIG. 43 is a front view of the blade cartridge of FIG. 42.
Figure 44:
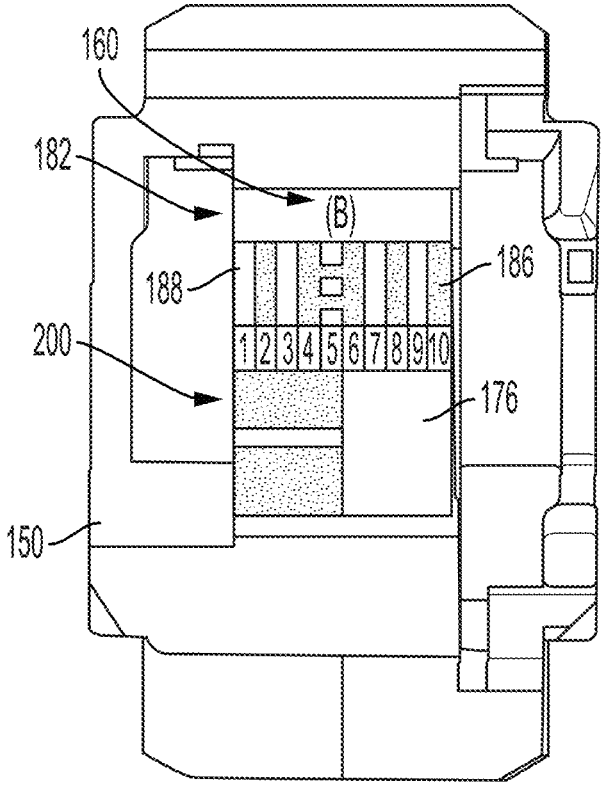
FIG. 44 is a rear view of the blade cartridge of FIG. 42.

FIG. 42 is an internal side view of another embodiment of a blade cartridge 150 and blade window 176. In the embodiment of FIG. 42, the cartridge includes a cartridge window assembly 182 having a cartridge window enclosure 186 and a magnifying lens 184. The magnifying lens 184 may be a wide angle lens which increases the visible size of the side edges of the blades 200 to a user, whether the cartridge is disposed in a knife housing or disposed outside of the knife housing. Such an arrangement may greatly simplify a knife window disposed on a knife housing, as the optics may be calibrated with a focal point on the side edges of the blade regardless of the position of the knife window. Additionally, in some embodiments, a knife window may be omitted entirely, and the cartridge window enclosure may simply project from a hole formed in the knife housing. In some embodiments, the cartridge 150 may include cartridge window assemblies on both ends of the cartridge, as shown in FIGS. 43-44. However, in other embodiments, a cartridge may include a cartridge window assembly on a single end of the cartridge.

FIG. 43 is a front view and FIG. 44 is a rear view of another embodiment the blade cartridge and blade window of FIG. 42. As shown in FIG. 43, on a first end of the cartridge is the cartridge window assembly 182 including a cartridge window enclosure 186 and the blade window 176 which magnifies the side edges of the blades 200. In the embodiment of FIGS. 43-44, the cartridge window enclosure includes a diagram or graphic 188 which makes it simple and easy to determine how many blades are disposed in a particular compartment. The graphic includes a plurality of alternating vertical bars which denote the width of a magnified side edge of a blade. A bar with horizontal bars denotes a midpoint (e.g., 5 blades in FIGS. 43-44) which allows a user to easily count up or down to determine the number of blades in the compartment. Additionally, the graphic includes a side indicator 160 which alerts a user to which side of the cartridge is being used. Accordingly, a user may be able to determine at a glance (1) which side of the cartridge is being used; and (2) how many blades remain to be used from that side of the cartridge. Accordingly, before starting work, a user may provision the correct number of blades or bring replacement cartridges if the total number of unused blade edges is low, as indicated by cartridge window assembly 182. As shown in FIG. 44, in some embodiments one side of each blade may be marked with white paint or another color marking to denote which side of the cartridge is being used 150. Accordingly, in addition to the side indicator, a user may receive reinforced indicators as to the side of the cartridge currently being employed through the magnified blade window. Of course, both sides of the blades may be marked with paint or another suitable marking to improve visibility through the blade window 176 and/or indicate a side of the cartridge, as the present disclosure is not so limited.

Figure 45:
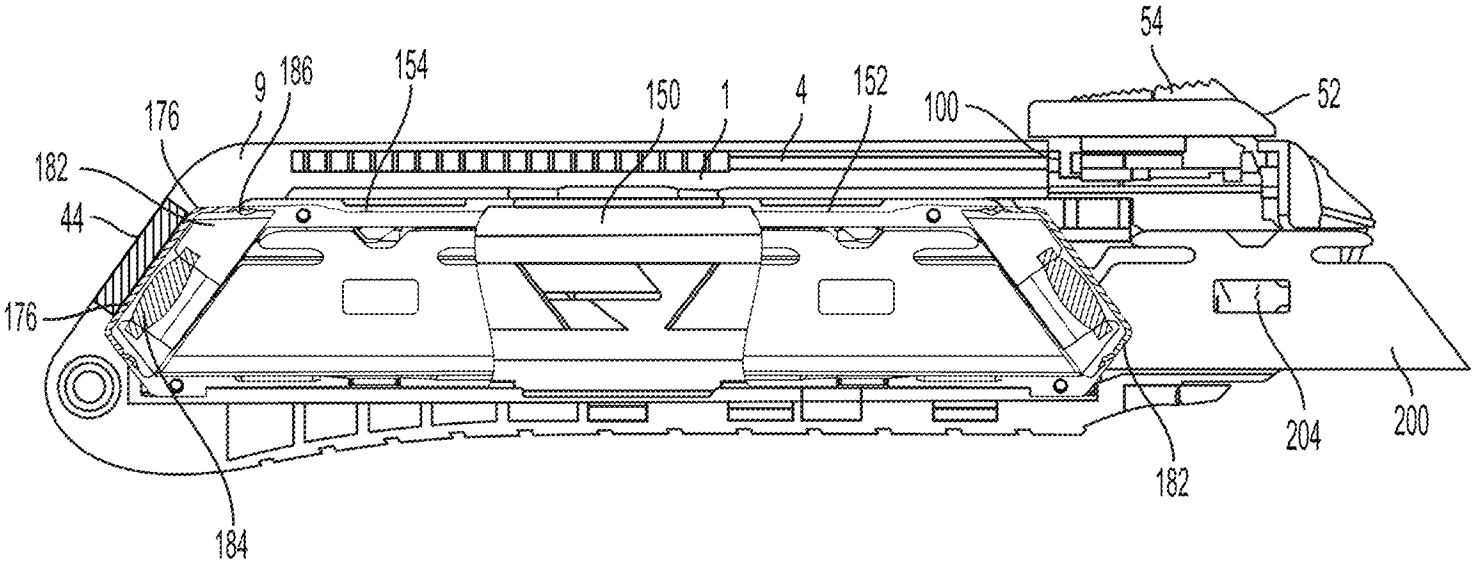
FIG. 45 is a side cutaway view of the blade cartridge of FIG. 42 disposed in one embodiment of a knife.

FIG. 45 is a side cutaway view of the blade cartridge 150 of FIG. 42 disposed in a knife 1. As shown in FIG. 45, each end of the blade cartridge includes a cartridge window assembly 182 that is accommodated inside of the utility knife 1. According to the embodiment of FIG. 45, the cartridge window assembly 182 on the rear portion 9 of the cartridge is aligned with a knife window 44 of a knife housing so that the cartridge window assembly is visible through the rear portion of the knife. More specifically, a blade window 176 and magnifying lens 184 are visible through the knife window as is any graphic included in the cartridge window assembly (for example, see FIG. 46). The blade window allows a user to count or otherwise see the number of blades disposed in a used blade compartment 154. Of course, in some embodiments, the knife housing may include a knife window on a front portion of the knife so that the blades in a new blade compartment are visible from outside the front portion of the knife. According to the embodiment shown in FIG. 45, the cartridge 150 with two blade window assemblies 182 is reversible in the knife so that each end of each blade may be used in a sequential manner as discussed above.

In some embodiments, a cartridge window assembly, blade window, and knife window may include any suitable combination of materials or lack thereof that allows a user to see into the cartridge. For example, in one embodiment, the cartridge window assembly, blade window, and knife window may be formed of one or more transparent materials such as acrylic, glass, or other transparent plastics. In other embodiments, at least one of the cartridge window assembly, blade window, and knife window may be configured as a slot, hole, or opening such that there is an absence of material which allows a user to see into the cartridge. Of course, any suitable combination of transparent materials and openings may be employed to allow a user to see into the cartridge, as the present disclosure is not so limited.

Figure 46:
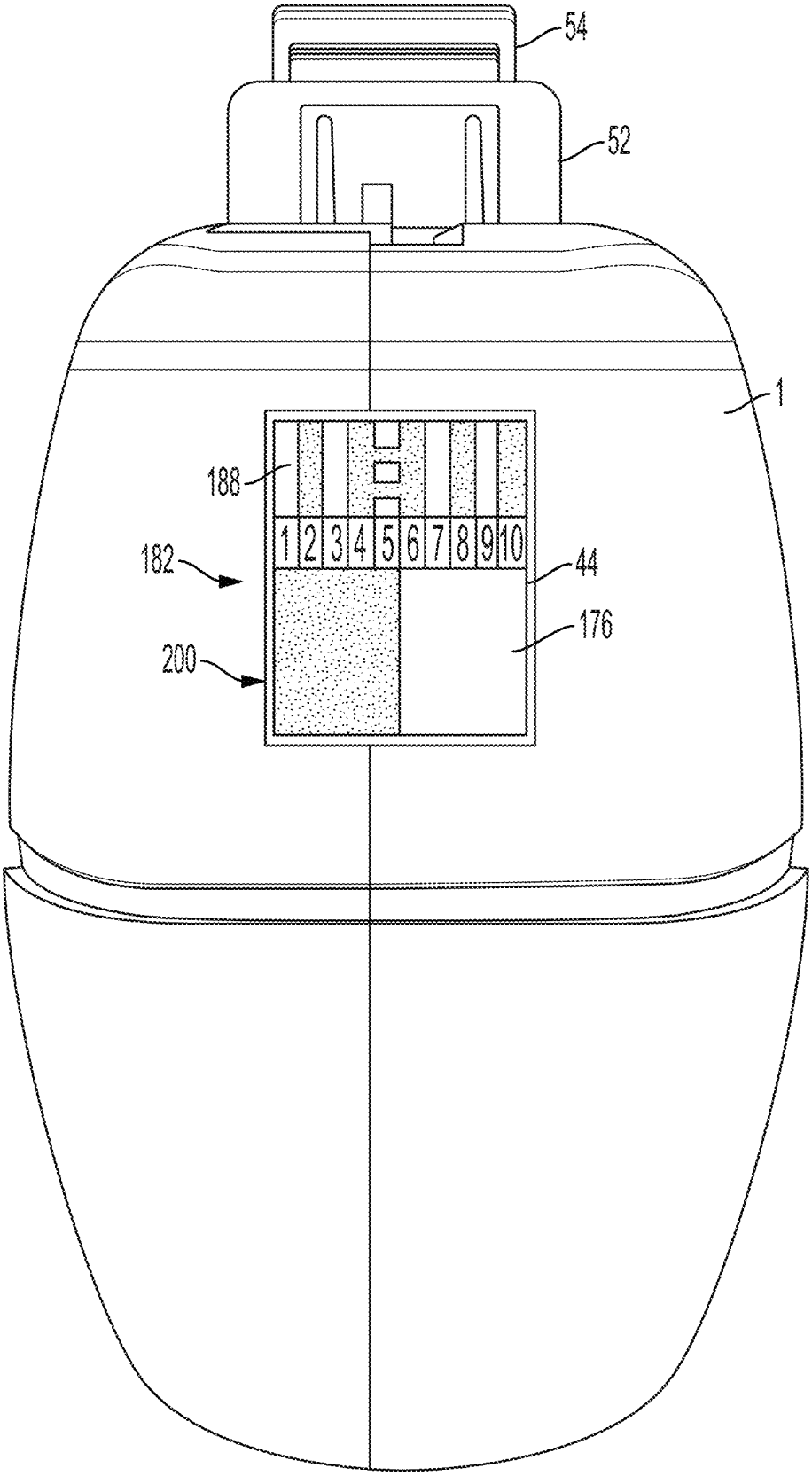
FIG. 46 is a rear view of one embodiment of a knife including a knife window.

FIG. 46 is a rear view of one embodiment of a knife including a knife window 44 which allows a user to view a cartridge window assembly 182 having a blade window 176 and a graphic or diagram 188 formed on an end of the cartridge from outside of the knife. As discussed above, the cartridge window allows a user to view into the used blade compartment of the cartridge to see a number of blades disposed in the used blade compartment. The graphic or diagram 188 disposed in the cartridge window assembly allows a user to easily see and/or count how many blades 200 are disposed in the used blade compartment. As the total number of blades in the cartridge is predetermined, a user may use the information from knife window to determine how many blades remain for use in a new blade compartment.

Figure 47:
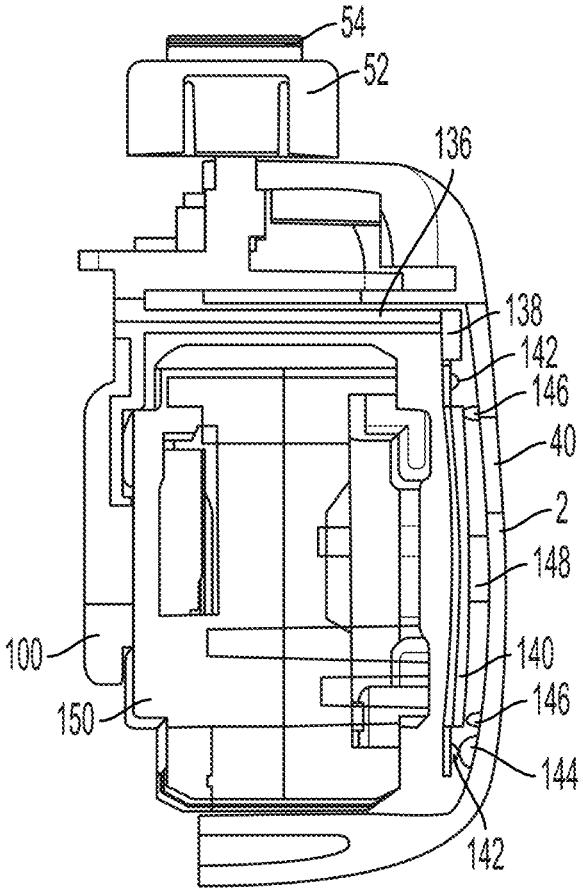
FIG. 47 is a rear internal view of one embodiment of a utility knife and a blade counter.

FIG. 47 is a rear internal view of one embodiment of a blade counter which displays a blade number indication as the carrier 100 is actuated to move blades between a new blade compartment and used blade compartment as described above. According to the embodiment in FIG. 47, the carrier includes a first indicator arm 136 and a second indicator arm 138 which cooperate with a blade wheel 140 which includes marking which indicate the number of the blade in use, and therefore inherently the number of blades used or the number of blades remaining. The blade wheel is arranged adjacent a right side housing section 2 and may be visible through a side window 40. The blade wheel is held in a rotational position with wheel detents 142 and housing detents 144, which releasably retain the blade wheel in a rotational position. A wheel guide 146 and shaft 148 ensure the blade wheel rotates about a proper axis and is spaced from the knife housing. As will be discussed further with reference to FIG. 48, each time the carrier is moved rearward to deposit a blade in the used blade compartment, the blade wheel may be incrementally rotated to denote a number blade number is in use.

Figure 48:
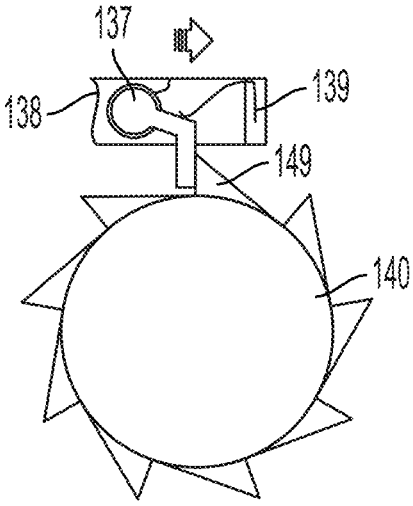
FIG. 48 is a side view of the blade counter of FIG. 47.

FIG. 48 is a side view of the blade counter of FIG. 47. The second indicator arm 138 includes a sprung pusher arm 137 which engages the blade wheel 140 as a blade is deposited in the used blade compartment. The pusher arm 137 is biased towards the blade wheel 140 with a pusher spring 139 so that the pusher arm engages one of the plurality of flanges 149 or teeth disposed around the blade wheel. When the second indicator arm is moves toward the rear of the knife, the pusher arm engages one of the flanges and rotates the blade wheel until the pusher arm clears the flange on which it is engaged. When the second indicator arm returns the opposite direction (e.g., after a blade is deposited in a used blade compartment), the pusher arm may contact an inclined side of the next flange which lifts the pusher against the biasing force of the pusher spring 139. Accordingly, the pusher arm is moved out of the way of the next flange and the blade wheel is not rotated as the second indicator arm is moved toward a forward portion of the knife (e.g., to pick up a new blade from the new blade compartment). In this manner, the blade wheel may be incrementally rotated for each cycle of the carrier, so that a different blade indication may be displayed for each consecutive cycle of the carrier.

Figure 49:
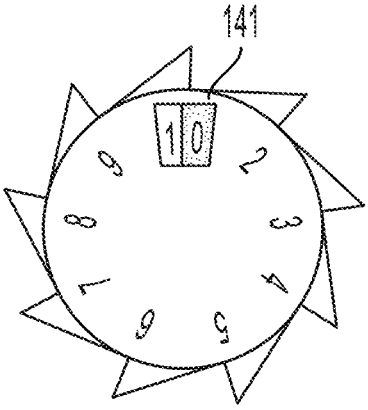
FIG. 49 is a side view of one embodiment of blade counter markings.

FIG. 49 is a side view of one embodiment of blade counter markings 141. A side window formed in a knife housing may be sized and shaped in some embodiments so that only one of the markings is visible through the knife housing. The number may correspond to a number of a blade from the new blade compartment which is currently in use.

Figure 50:
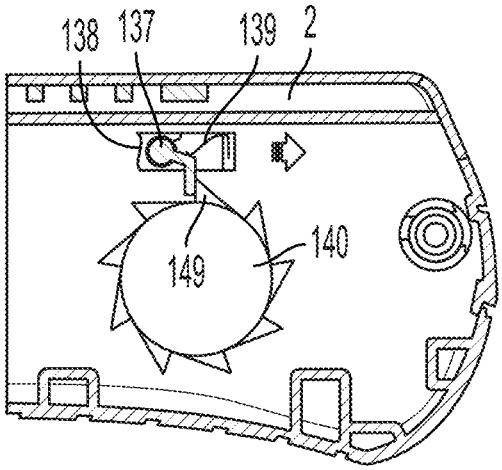
FIG. 50 is a side view of the blade counter of FIG. 48 in a first position.
Figure 51:
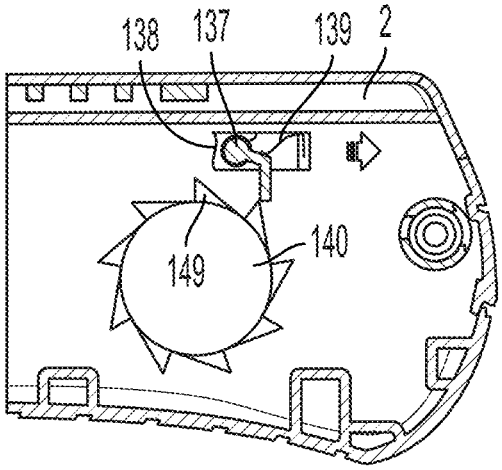
FIG. 51 is a side view of the blade counter of FIG. 48 in a second position.
Figure 53:
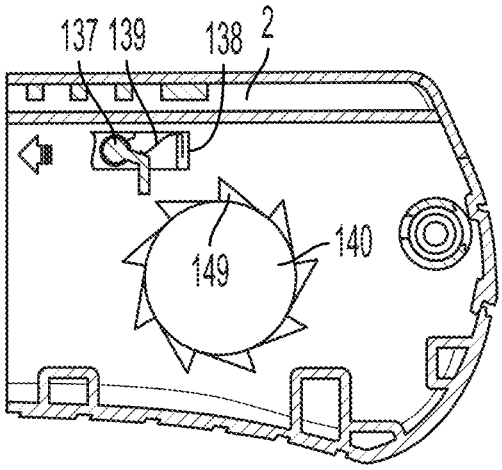
FIG. 53 is a side view of the blade counter of FIG. 48 in a fourth position.
Figure 52:
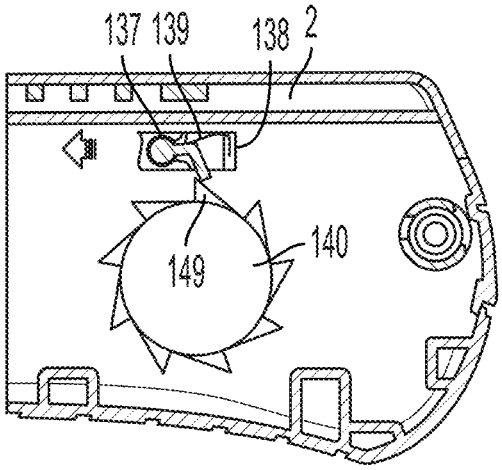
FIG. 52 is a side view of the blade counter of FIG. 48 in a third position.

FIGS. 50-53 depict side views of the blade counter of FIG. 48 in various positions as the second indicator arm 138 is retracted. As shown in FIG. 50, the second indicator arm is moved rearwards and the pusher arm 139 engages a flange of the blade wheel 140. As shown in FIG. 51, the pusher has rotated the blade wheel so that a new indication number is displayed through a side window formed in the housing 2. As a blade is deposited in a used blade compartment, the direction of the second indicator arm is reversed as shown in FIG. 52. As the pusher arm 137 engages the next flange, the pusher arm is lifted by the flange against the biasing force of the pusher spring 139 until the pusher arm clears the flange, such that the blade wheel is not rotated. As shown in FIG. 53, once the pusher arm clears the blade wheel the second indicator arm may be moved freely forward so that the carrier can engage a new blade for use.

Figure 54:
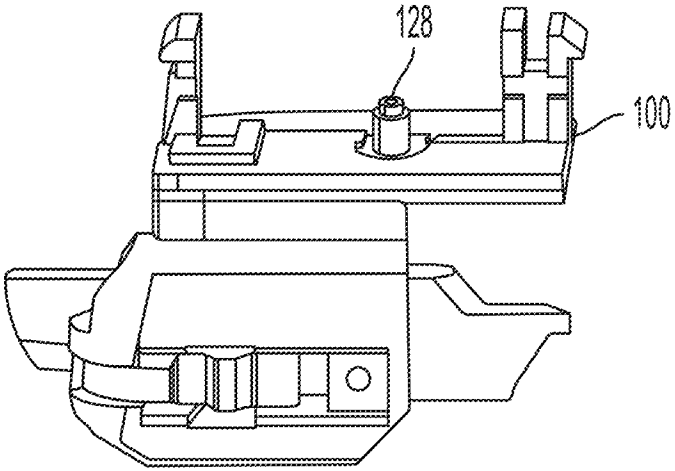
FIG. 54 is a perspective view of another embodiment of a carrier.

FIG. 54 is a perspective view of another embodiment of a carrier 100 including a cam post 128. In some cases, it may be undesirable for a carrier to be stopped and reversed when an engaged blade is partially between a new blade compartment and a used blade compartment. Depending on the arrangement of springs and gates, the blade may become disengaged from the carrier and jam in the knife. Accordingly, the cam post and associated cam may be employed along with a cam platform to inhibit improper movement of the carrier once a blade has been partially moved to the used blade compartment. In particular, the cam ensures that the complete cycle of blade deposit in the used blade compartment is completed once started.

Figure 55:
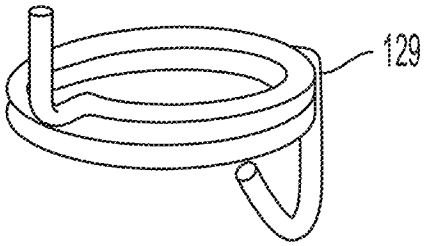
FIG. 55 is a perspective view of one embodiment of a cam torsion spring.

FIG. 55 is a perspective view of one embodiment of a cam torsion spring 129. The torsion spring may be disposed about the cam post 128 and bias an associated cam into engagement with a cam platform, as will be discussed further with reference to FIG. 56.

Figure 56:
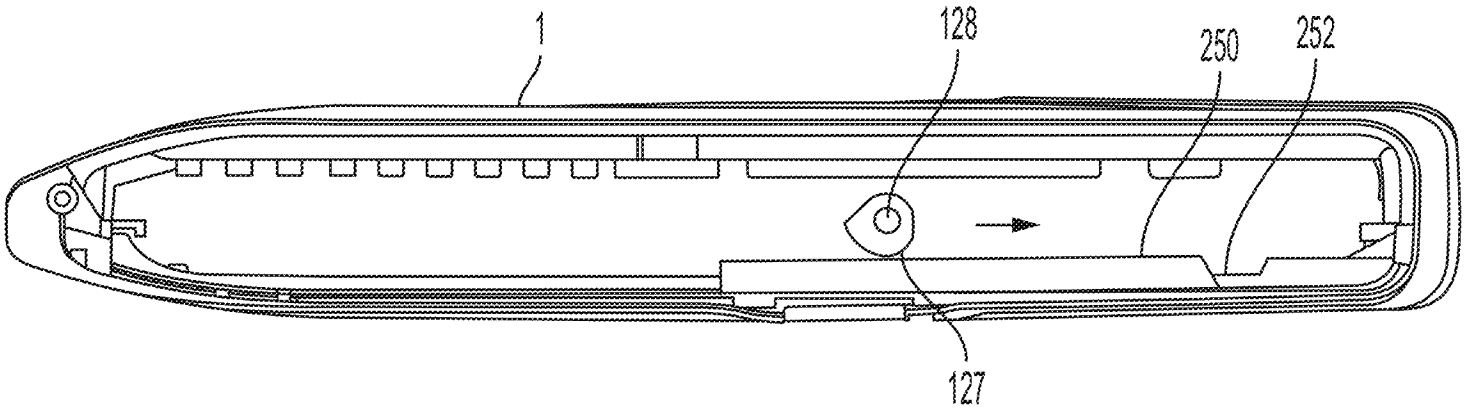
FIG. 56 is a top schematic of one embodiment of a cam lock.

FIG. 56 is a top schematic view of one embodiment of a cam lock 127 and cam platform 250 for ensuring a blade change process is completed once started. As shown in FIG. 56, the cam lock includes a lobe which is biased into engagement with the cam platform 250 which is formed as a part of a knife 1. As the cam lock is moved rearward along the cam platform, the frictional force rotates the cam lock in a direction out of engagement with the cam platform, so that the cam lock does not substantially resist movement of the cam lock in a rearward direction. However, if the direction is reversed, the frictional force and biasing force from the torsion spring urge the cam lock into further engagement with the cam platform 250, causing induced frictional force which effectively inhibits the cam lock from being moved toward a forward portion of the knife. A cam notch 250 switches the cam lock and allows the cam lock to be moved in a forward direction. The cam notch corresponds to a fully rearward position of the carrier where a used blade is successfully deposited in a used blade compartment. Accordingly, the cam lock ensures a blade change process is fully completed, as will be shown further in FIGS. 57-58.

Figure 57:
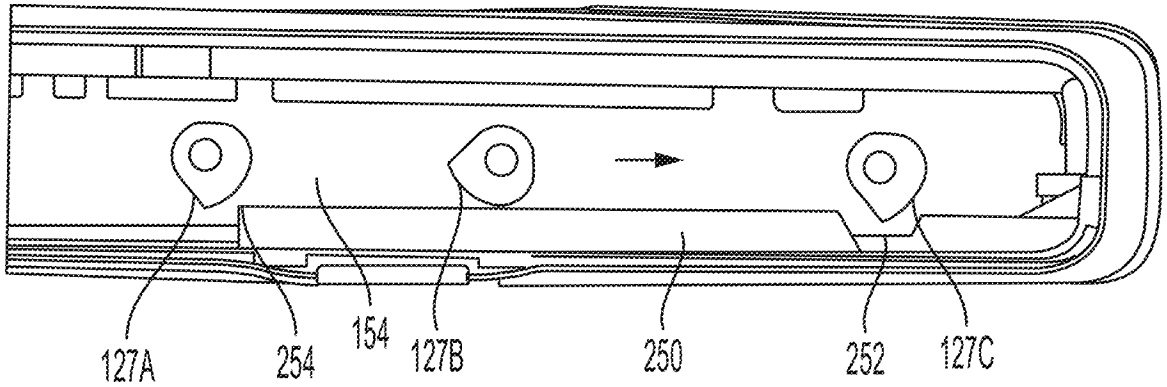
FIG. 57 is a top diagram of the cam lock of FIG. 56.

FIG. 57 is a top diagram of the cam lock 127 of FIG. 56 moving in a rearward, unrestricted direction. In the position shown by 127A, the cam lock is in a resting position as biased by the torsion spring, and is moved rearward into contact with the cam platform 250. More specifically, the cam lock 127A is moved into engagement with a first cam corner 254 which rotates the cam lock in a clockwise direction relative to the page. As the cam lock is moved to the position shown by 127B, the frictional forces continue to rotate the cam lock in a clockwise direction relative to the page so that the cam lock does not substantially resist movement. However, in the position shown by cam lock 127B, movement in an opposite direction will result in the cam lock impinging on the cam platform and inhibiting movement in a forward direction. When the cam lock reaches the position shown by 127C, the cam notch 252 frees the cam lock to rotate to the resting position. When the cam lock is in the position shown by 127C, the associated carrier may be in a rearmost position and a used blade successfully deposited in a used blade compartment.

Figure 58:
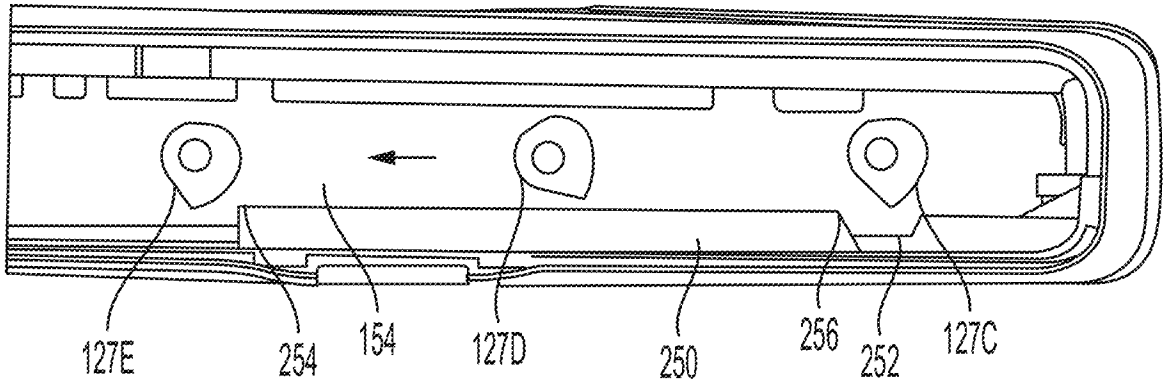
FIG. 58 is a top diagram of the cam lock of FIG. 56.

FIG. 58 is a top diagram of the cam lock 127 of FIG. 58 moving in a forward direction after a used blade has been deposited in a used blade compartment. As shown by 127C, the cam lock is in a resting position in cam notch 252. As the cam lock is moved forward toward the position shown by 127D, the cam lock engages a second cam corner 256 which rotates the cam lock counter clockwise relative to the page so that the cam lock may easily slide on the cam platform 250. As shown by cam lock 127B, moving the cam lock forward is not restricted as frictional forces rotate the cam lock out of engagement with the cam platform rather than into further engagement. Once the cam lock reaches the position shown by 127E, the blade change cycle has been completed. Accordingly, the cam lock arrangement shown in FIGS. 57-58 is suitable to ensure an entire blade change process is fully completed.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A utility knife comprising:

an opaque knife housing including a cartridge receptacle;

a cartridge disposed in the cartridge receptacle, comprising:

an opaque cartridge housing including a first blade compartment positioned adjacent a first longitudinal end of the cartridge housing and a second blade compartment positioned adjacent a second longitudinal end of the cartridge housing, wherein the cartridge housing is sized and shaped to be positioned in the cartridge receptacle of the knife housing in at least a first orientation and a second orientation, and wherein the cartridge housing is formed by first and second halves joined at a parting line, a plurality of blades disposed in at least one of the first blade compartment and the second blade compartment, wherein each of the blades includes:

a front portion including a front edge, a rear portion including a rear edge, a least one sharpened lower edge disposed adjacent the front portion or rear portion, and a first longitudinal slot formed in the rear edge, wherein the first longitudinal slot has a first upper surface and a first lower surface, wherein the first upper surface includes a first lead-in to the first longitudinal slot at the rear edge, and a blade window formed as a hole on the first longitudinal end of the cartridge housing and configured to allow a user to view only a rear edge of each of the plurality of blades in the first blade compartment, wherein the blade window spans the parting line;

a carrier movable relative to the knife housing for moving a blade from the second blade compartment to an extended position where the blade extends out of the knife housing and from the extended position to the first blade compartment, wherein the carrier includes a lifter configured to engage the longitudinal slot when the carrier is moved to move a blade from the second blade compartment to the extended position, wherein the lifter includes a ramped leading surface configured to engage the first lead-in of the longitudinal slot to lift the blade and align the longitudinal slot with the lifter; and a knife window formed on the knife housing aligned with the blade window, the blade window and knife window arranged to allow the user to view only the rear edge of each of the plurality of blades in a direction parallel to a plane defined by each of the plurality of blades.

2. The utility knife of claim 1, wherein the blade window includes a plurality of labels which align with the blades disposed in the first blade compartment and indicate the number of blades in the first blade compartment.

3. The utility knife of claim 1, wherein the knife window includes a plurality of labels which align with the blades disposed in the first blade compartment and indicate the number of blades in the first blade compartment.

4. The utility knife of claim 1, wherein each of the plurality of blades includes a marking disposed on the rear edge visible through the blade window.

5. The utility knife of claim 1, wherein the blade cartridge further comprises an indicator formed on the cartridge housing which denotes the first longitudinal end and the second longitudinal end.

6. The utility knife of claim 5, wherein the indicator is visible through the knife window, so that a user may determine the orientation of the cartridge in the cartridge receptacle.

7. The utility knife of claim 6, wherein the indicator includes a first marking disposed on the first longitudinal end of the cartridge housing and a second marking disposed on the second longitudinal end of the cartridge housing, wherein the first marking is visible through the knife window when the cartridge is in the first orientation and the second marking is not visible, and wherein the second marking is visible through the knife window and the first marking is not visible when the cartridge is in the second orientation.

8. The utility knife of claim 1, wherein the knife window includes a magnifying lens.

9. The utility knife of claim 1, wherein the cartridge housing includes a plurality of light slots formed in the first longitudinal end configured to allow light to enter the first blade compartment.

10. The utility knife of claim 9, wherein the light slots extend in a longitudinal direction along the cartridge housing.

11. The utility knife of claim 1, further comprising an alignment post, wherein the cartridge further comprises a retaining channel formed in the cartridge housing and configured to receive the alignment post, and wherein the retaining channel is sized and shaped so that when the retaining channel receives the alignment post the cartridge is aligned with the cartridge receptacle.

12. The utility knife of claim 1, wherein the first blade compartment is a used blade compartment.

13. The utility knife of claim 12, wherein the blade window allows a user to view the rear edge of each blade disposed in the used blade compartment.

14. The utility knife of claim 1, wherein the lifter has a height, and a leading end of the ramped leading surface is positioned in a lower half of the lifter height.

15. The utility knife of claim 1, wherein the ramped leading surface has a linear portion extending rearwardly and upwardly between a forward-most end of the lifter and an upper surface of the lifter.

16. The utility knife of claim 1, wherein the lifter includes upper and lower surfaces that are parallel to each other, and the ramped leading surface extends between the upper and lower surface of the lifter at a forward-most end of the lifter, and wherein the ramped leading surface extends forwardly and downwardly from the upper surface to the lower surface of the lifter.

* * * * *